US005540280A

United States Patent [19]

Schultz et al.

[11] Patent Number: 5,540,280

[45] Date of Patent: Jul. 30, 1996

[54] EARLY EVALUATION SYSTEM

[75] Inventors: Roger H. Schultz, Stillwater, Okla.; H. Kent Beck, Copper Canyon; Paul D. Ringgenberg, Carrollton, both of Tex.

[73] Assignee: Halliburton Company, Houston, Tex.

[21] Appl. No.: 292,131

[22] Filed: Aug. 15, 1994

[51] Int. Cl.[6] ..... E21B 47/00

[52] U.S. Cl. ..... 166/250.07; 166/264

[58] Field of Search ..... 166/250, 264, 166/307, 373, 384, 385, 386, 387, 319, 324, 334, 185, 187, 191

[56] References Cited

U.S. PATENT DOCUMENTS

| | | | |
|---|---|---|---|
| 1,899,497 | 2/1933 | Doherty . | |
| 2,125,159 | 7/1938 | Hanes | 166/1 |
| 2,222,829 | 11/1940 | Humason et al. | 166/1 |
| 2,280,785 | 7/1942 | Boynton | 166/11 |
| 2,392,683 | 1/1946 | McWhorter | 255/1.4 |
| 2,497,185 | 2/1950 | Reistle, Jr. | 166/1 |
| 2,677,790 | 5/1954 | Arps | 224/1 |
| 2,702,474 | 2/1955 | Johnston | 73/152 |
| 2,751,016 | 6/1956 | Watzlavick | 166/187 |
| 3,103,811 | 9/1963 | Ayres et al. | 73/152 |
| 3,107,729 | 10/1963 | Barry et al. | 166/66 |
| 3,111,169 | 11/1963 | Hyde | 166/145 |
| 3,175,392 | 3/1965 | Tharalson et al. | 73/84 |
| 3,182,725 | 5/1965 | Moore | 166/65 |
| 3,279,249 | 10/1966 | Tocanne | 73/153 |
| 3,327,781 | 6/1967 | Nutter | 166/3 |
| 3,353,612 | 11/1967 | Bannister | 175/6 |
| 3,412,607 | 11/1968 | Jensen | 73/155 |
| 3,441,095 | 4/1969 | Youmans | 175/59 |
| 3,448,611 | 6/1969 | Lebourg | 73/151 |
| 3,459,264 | 8/1969 | Olson et al. | 166/250 |
| 3,500,911 | 3/1970 | Farley et al. | 166/250 |
| 3,577,781 | 5/1971 | Lebourg et al. | 73/152 |
| 3,577,783 | 5/1971 | Whitten et al. | 73/152 |
| 3,611,799 | 10/1971 | Davis | 73/155 |
| 3,780,575 | 12/1973 | Urbanosky | 73/152 |
| 3,850,240 | 11/1974 | Conover | 166/162 |
| 3,864,970 | 2/1975 | Bell | 73/155 |
| 3,876,003 | 4/1975 | Kisling, III | 166/250 |
| 3,895,520 | 7/1975 | Fertl | 73/152 |
| 3,969,937 | 7/1976 | Barrington et al. | 73/151 |
| 4,031,957 | 6/1977 | Sanford | 166/264 |
| 4,043,407 | 8/1977 | Wilkins | 175/50 |
| 4,230,180 | 10/1980 | Patton et al. | 166/185 |
| 4,246,964 | 1/1981 | Brandell | 166/106 |
| 4,287,946 | 9/1981 | Brieger | 166/100 |
| 4,313,495 | 2/1982 | Brandell | 166/53 |
| 4,339,948 | 7/1982 | Hallmark | 73/155 |
| 4,370,886 | 2/1983 | Smith, Jr. et al. | 73/153 |
| 4,392,376 | 7/1983 | Lagus et al. | 73/155 |
| 4,498,536 | 2/1985 | Ross et al. | 166/307 X |
| 4,535,843 | 8/1985 | Jageler | 166/250 |
| 4,566,535 | 1/1986 | Sanford | 166/113 |
| 4,573,532 | 3/1986 | Blake | 166/264 |
| 4,580,632 | 4/1986 | Reardon | 166/250 |

(List continued on next page.)

*Primary Examiner*—William P. Neuder
*Attorney, Agent, or Firm*—William M. Imwalle; C. Clark Dougherty, Jr.

[57] ABSTRACT

A number of improvements are provided in early evaluation systems which can be utilized to test and/or treat a subsurface formation intersected by an open uncased borehole. An outer tubing string is run into the well and has a packer which is set in the open, uncased borehole above the subsurface formation of interest. An inflation passage is provided and preferably has an inflation valve associated therewith which is operated by manipulation of the tubing string. A communication passage communicates the interior of the outer tubing string with the borehole below the packer. An inner well tool is run into the outer tubing string and engaged therewith, whereupon it is placed in fluid communication with the subsurface formation to either sample the formation or treat the formation. Preferably, a circulating valve is provided above the packer to allow fluid circulation in the well annulus during the testing procedure to prevent differential sticking of the outer tubing string. The inner well tool may include an inner tubing string, preferably coiled tubing, which may include annulus pressure responsive tester valves therein.

50 Claims, 28 Drawing Sheets

U.S. PATENT DOCUMENTS

| | | | |
|---|---|---|---|
| 4,583,595 | 4/1986 | Czernichow et al. | 166/264 |
| 4,635,717 | 1/1987 | Jageler | 166/250 |
| 4,729,430 | 3/1988 | White | 166/106 |
| 4,745,802 | 5/1988 | Purfurst | 73/155 |
| 4,790,378 | 12/1988 | Montgomery et al. | 166/250 X |
| 4,838,349 | 6/1989 | Berzin | 166/187 |
| 4,860,580 | 8/1989 | DuRocher | 73/155 |
| 4,866,607 | 9/1989 | Anderson et al. | 364/422 |
| 4,898,236 | 2/1990 | Sask | 166/65.1 |
| 4,936,139 | 6/1990 | Zimmerman et al. | 73/155 |
| 4,955,438 | 9/1990 | Juergens et al. | 175/40 |
| 4,962,815 | 10/1990 | Schultz et al. | 166/387 |
| 5,058,674 | 10/1991 | Schultz et al. | 166/264 |
| 5,095,745 | 3/1992 | Desbrandes | 73/152 |
| 5,105,881 | 4/1992 | Thoms et al. | 166/250 |
| 5,184,508 | 2/1993 | Desbrandes | 73/152 |
| 5,287,741 | 2/1994 | Schultz et al. | 166/264 X |

EARLY EVALUATION SYSTEM

BACKGROUND OF THE INVENTION

1. Field of the Invention

The present invention relates generally to methods and apparatus for servicing a well, and more particularly to methods and apparatus for the early evaluation of a well after the borehole has been drilled and before casing has been cemented in the borehole.

2. Description of the Prior Art

During the drilling and completion of oil and gas wells, it is often necessary to test or evaluate the production capabilities of the well. This is typically done by isolating a subsurface formation which is to be tested and subsequently flowing a sample of well fluid either into a sample chamber or up through a tubing string to the surface. Various data such as pressure and temperature of the produced well fluids may be monitored down hole to evaluate the long-term production characteristics of the formation.

One very commonly used well testing procedure is to first cement a casing in the borehole and then to perforate the casing adjacent zones of interest. Subsequently the well is flow tested through the perforations. Such flow tests are commonly performed with a drill stem test string which is a string of tubing located within the casing. The drill stem test string carries packers, tester valves, circulating valves and the like to control the flow of fluids through the drill stem test string.

Although drill stem testing of cased wells provides very good test data, it has the disadvantage that the well must first be cased before the test can be conducted. Also, better reservoir data can often be obtained immediately after the well is drilled and before the formation has been severely damaged by drilling fluids and the like.

For these reasons it is often desired to evaluate the potential production capability of a well without incurring the cost and delay of casing the well. This has led to a number of attempts at developing a successful open-hole test which can be conducted in an uncased borehole.

One approach which has been used for open-hole testing is the use of a weight-set, open-hole compression packer on a drill stem test string. To operate a weight-set, open-hole compression packer, a solid surface must be provided against which the weight can be set. Typically this is accomplished either with a tapered rathole type packer as shown in U.S. Pat. No. 2,222,829 to Humason et al., or with a perforated anchor which sets down on the bottom of the hole. A disadvantage of the use of open-hole compression set type packers is that they can only be used adjacent the bottom of the hole. Thus, it is necessary to immediately test a formation of interest after it has been drilled through. These types of packers cannot be utilized to test a subsurface formation located at a substantial height above the bottom of the hole. Also, this type of test string is undesirable for use offshore because the pipe string can become stuck in the open borehole due to differential pressures between the borehole and various formations. As will be understood by those skilled in the art, when the pipe string is fixed and is no longer rotating, portions of the pipe string will lie against the side of the borehole and sometimes a differential pressure situation will be encountered wherein the pipe string becomes very tightly stuck against the side wall of the borehole. This is especially a dangerous problem when the flow control valves of the test string are operated by manipulation of the test string. In these situations, if the test string becomes stuck it may be impossible to control the flow of fluid through the test string.

Another prior art procedure for open-hole testing is shown in U.S. Pat. No. 4,246,964 to Brandell, and assigned to the assignee of the present invention. The Brandell patent is representative of a system marketed by the assignee of the present invention as the Halliburton Hydroflate system. The Hydroflate system utilizes a pair of spaced inflatable packers which are inflated by a downhole pump. Well fluids can then flow up the pipe string which supports the packers in the well. This system still has the disadvantage that the pipe string is subject to differential sticking in the open borehole.

Another approach to open-hole testing is through the use of pad-type testers which simply press a small resilient pad against the side wall of the borehole and take a very small unidirectional sample through an orifice in the pad. An example of such a pad-type tester is shown in U.S. Pat. No. 3,577,781 to Lebourg. The primary disadvantage of pad-type testers is that the take a very small unidirectional sample which is often not truly representative of the formation and which provides very little data on the production characteristics of the formation. It is also sometimes difficult to seal the pad. When the pad does seal, it is subject to differential sticking and sometimes the tool may be damaged when it is removed.

Another approach which has been proposed in various forms, but which to the best of our knowledge has never been successfully commercialized, is to provide an outer tubing string with a packer which can be set in a borehole, in combination with a wireline-run surge chamber which is run into engagement with the outer string so as to take a sample from below the packer. One example of such a system is shown in U.S. Pat. No. 3,111,169 to Hyde, and assigned to the assignee of the present invention. Other examples of such devices are seen in U.S. Pat. Nos. 2,497,185 to Reistle, Jr.; 3,107,729 to Barry et al.; 3,327,781 to Nutter; 3,850,240 to Conover; and 3,441,095 to Youmans.

The present invention provides a number of improvements in open-hole testing systems of the type generally proposed in U.S. Pat. No. 3,111,169 to Hyde.

SUMMARY OF THE INVENTION

In a first aspect of the present invention a system is provided including an outer tubing string having an inflatable packer, a communication passage disposed through the tubing string below the packer, an inflation passage communicated with the inflatable element of the packer, and an inflation valve controlling flow of inflation fluid through the inflation passage. The inflation valve is constructed so that the opening and closing of the inflation valve is controlled by surface manipulation of the outer tubing string. Thus the inflatable packer can be set in the well simply by manipulation of the outer tubing string and applying fluid pressure to the tubing string without running a surge chamber or other inner well tool into the tubing string. After the packer has been set, an inner well tool such as a surge chamber may be run into and engaged with the outer tubing string to place the inner well tool in fluid communication with a subsurface formation through the communication passage.

In another aspect of the invention, a system similar to that just described utilizes a retrievable straddle packer having upper and lower packer elements, and includes a circulating valve located above the upper packer element. The communication passage terminates between the upper and lower packer elements. With this system, both before and after the inner well tool is run into and engaged with the outer tubing string, the circulating valve may be utilized to circulate fluid through the well annulus so that differential sticking of the outer tubing string in the borehole is prevented.

In yet another aspect of the invention, the well fluid samples are collected by running an inner tubing string, preferably an inner coiled tubing string, into the previously described outer tubing string. The coiled tubing string is engaged with the outer tubing string and the bore of the coiled tubing string is communicated with a subsurface formation through the communication passage defined in the outer tubing string. Then well fluid from the subsurface formation is flowed through the communication passage and up through the coiled tubing string. Such a coiled tubing string may include various valves for control of fluid flow therethrough. In a preferred embodiment the coiled tubing string utilizes annulus pressure responsive control valves which are controlled by pressure changes in a tubing annulus defined between the coiled tubing string and the outer tubing string.

In still another aspect of the present invention, the system can be utilized to treat a subsurface formation. Instead of running a surge chamber to collect a sample of fluid, a pressurized injection canister is run into and engaged with the outer tubing string. The pressurized injection canister is communicated with the subsurface formation through the communication passage. A treatment fluid such as acid can then be injected into the subsurface formation.

Numerous objects, features and advantages of the present invention will be readily apparent to those skilled in the art upon a reading of the following disclosure when taken in conjunction with the accompanying drawings.

BRIEF DESCRIPTION OF THE DRAWINGS

FIG. 1A illustrates the outer tubing string after it has been run into the well to a position adjacent a subsurface formation of interest. In FIG. 1B, the packers have been set in the uncased borehole and a wireline-run surge chamber is being run down into the outer tubing string. In FIG. 1C, the surge chamber is engaged with the surge receptacle of the outer tubing string and a well fluid sample is flowing into the surge chamber.

FIG. 2A shows the outer tubing string being run into the well to a position adjacent a subsurface formation of interest. In FIG. 2B, the packers have been set in the borehole and an inner coiled tubing string is being run into place. In FIG. 2C, the inner coiled tubing string has been engaged with the outer tubing string and well fluid from the formation is being allowed to flow up through the coiled tubing string.

FIGS;. 4A–4E comprise an elevation sectioned view of the assembly shown in FIGS. 3A–3E, with the addition that a surge chamber is shown partially run into place within the assembly in a manner similar to that schematically represented in FIG. 1B.

DETAILED DESCRIPTION OF THE PREFERRED EMBODIMENTS

General Description Of The Methods Schematically Illustrated in FIGS. 1A–1C and 2A–2C FIGS. 1A–1C schematically illustrate a method of servicing a well 10 having an uncased borehole 12 intersecting a subsurface formation or zone 14. As used herein, a reference to a method of servicing a well is used in a broad sense to include both the testing of the well wherein fluids are allowed to flow from the well and the treatment of a well wherein fluids are pumped into the well.

Figure 1C:
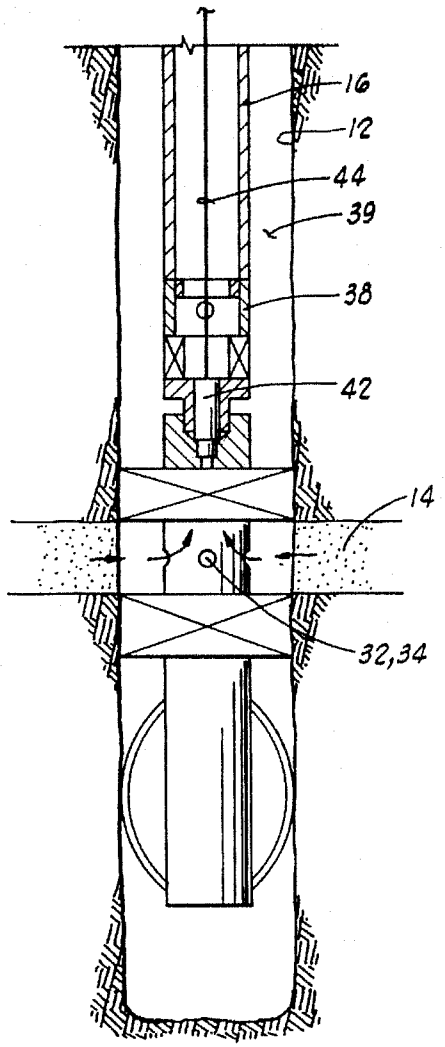
FIGS. 1A–1C comprise a series of three sequential schematic representations of the use of a first embodiment of the invention having an outer tubing string with a surge chamber, or an injection canister or the like run on wireline into the outer tubing string.
Figure 1B:
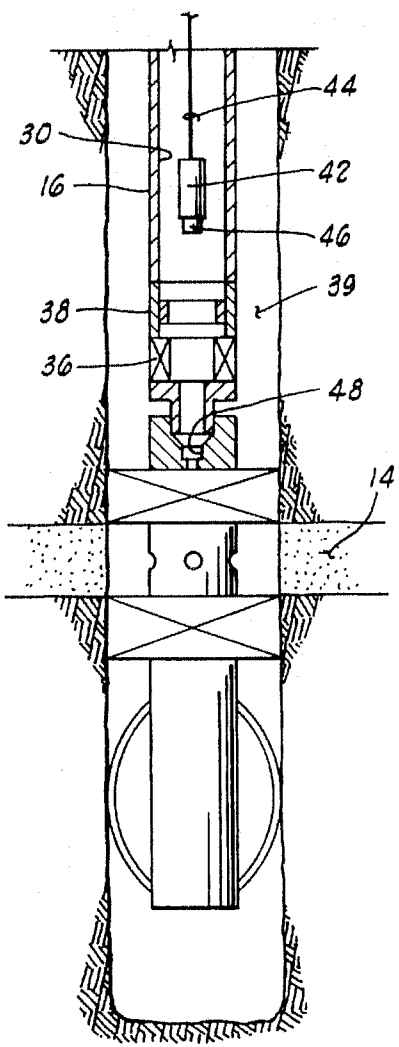
Figure 1A:
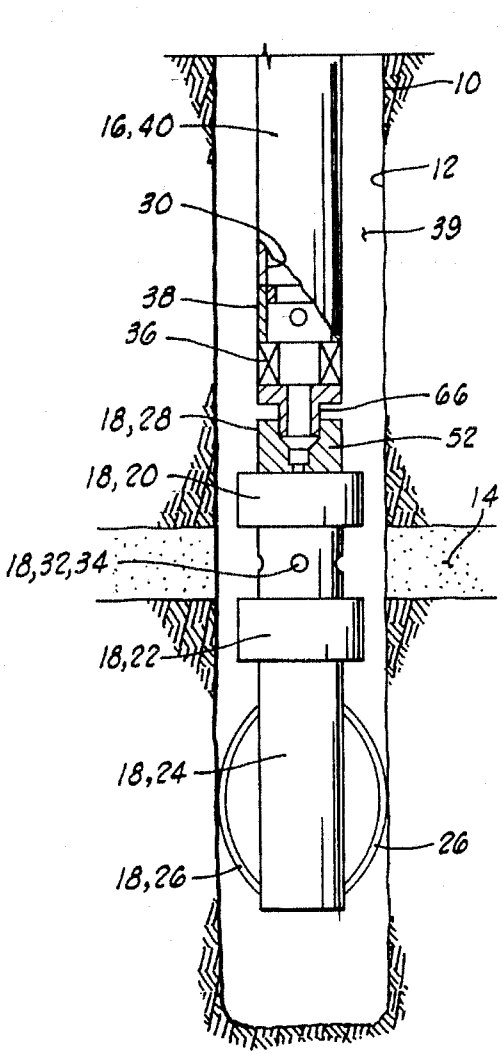

As illustrated in FIG. 1A, first an outer tubing string generally designated by the numeral 16 is run into the well 10. The outer tubing string includes a straddle packer assembly 18 having upper and lower inflatable packer elements 20 and 22, respectively. A lower housing 24 extends below the lower packer element 22 and has belly springs 26 extending radially therefrom and engaging the borehole 12 to aid in setting of the straddle packer 18.

By incorporating a swivel above the outer tubing string 16, the outer tubing string 16 can be rotated to aid in preventing differential sticking as the outer tubing string 16 is lowered into place.

The straddle packer 18 includes an inflation valve assembly 28 which controls flow of fluid from the interior 30 of the outer tubing string 16 to the inflatable elements 20 and 22 through an inflation passage which is further described below with regard to FIGS. 3A–3J.

The straddle packer 18 has a communication passage 32 defined therein including a plurality of ports 34 located between packer elements 20 and 22. The communication passage 32 communicates with the interior 30 of tubing string 16.

A well annulus 39 is defined between the uncased borehole 12 and the outer tubing string 16.

The outer tubing string 16 further includes a position correlation sub 36 and a circulating valve 38. All of these components are carried on an elongated string of tubing 40.

The correlation tool 36 preferably is a correlation sub having a radioactive tag therein which can be used to determine accurately the position of the outer tubing string 16 through the use of a conventional wireline run correlation tool which can locate the radioactive tag in correlation sub 36.

Typically after the borehole 12 has been drilled an open hole log will be run so as to identify the various zones of interest such as subsurface formation 14. Then the outer tubing string 16 is run into the well and located at the desired depth as determined by the previously run open hole log through the use of the correlation sub 36.

The tubing string 16 is run into the uncased borehole 12 as shown in FIG. 1A until the straddle packer elements 20 and 22 are located above and below a subsurface zone or formation 14 which is of interest.

Then the inflatable elements 20 and 22 are inflated to set them within the uncased borehole 12 as shown in FIG. 1B. As further described below with regard to FIGS. 3A–3J, the inflation and deflation of elements 20 and 22 is controlled by physical manipulation of the tubing string 16 from the surface.

In FIG. 1B an inner well tool 42 is being lowered into the outer tubing string 16 on a wireline 44. The inner well tool 42 includes a stinger element 46 on the lower end thereof which is adapted to be received in a seal bore 48 defined in the straddle packer assembly 18.

In FIG. 1C, the inner well tool 42 has been lowered into engagement with the outer tubing string 16 until the stinger element 46 is closely received within the seal bore 48 thus placing the inner well tool 42 in fluid communication with the subsurface formation 14 through the communication passage 32.

In one embodiment further illustrated in FIGS. 3–6 and 11, the inner well tool 42 is a surge chamber which collects a fluid sample from the subsurface formation 14 which can then be retrieved by retrieving the surge chamber with the wireline 44. In another embodiment illustrated in FIGS. 9 and 10, the inner well tool 42 is a pressurized fluid injection canister which will inject a treatment fluid into the subsurface formation 14 through the communication passage 32.

Figure 2C:
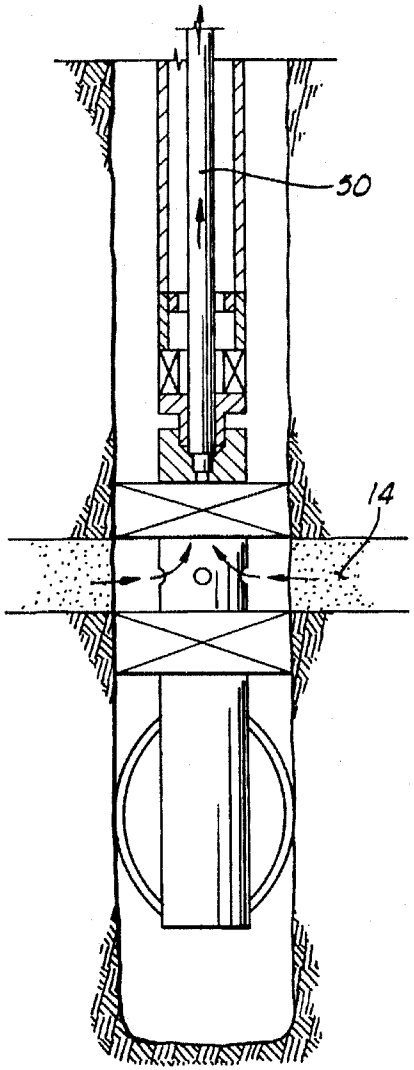
FIGS. 2A–2C comprise a series of three sequential schematic drawings illustrating a second embodiment of the invention wherein the wireline-run surge chamber is replaced with an inner coiled tubing string having a device on the lower end thereof for engagement with the surge receptacle of the outer tubing string.
Figure 2B:
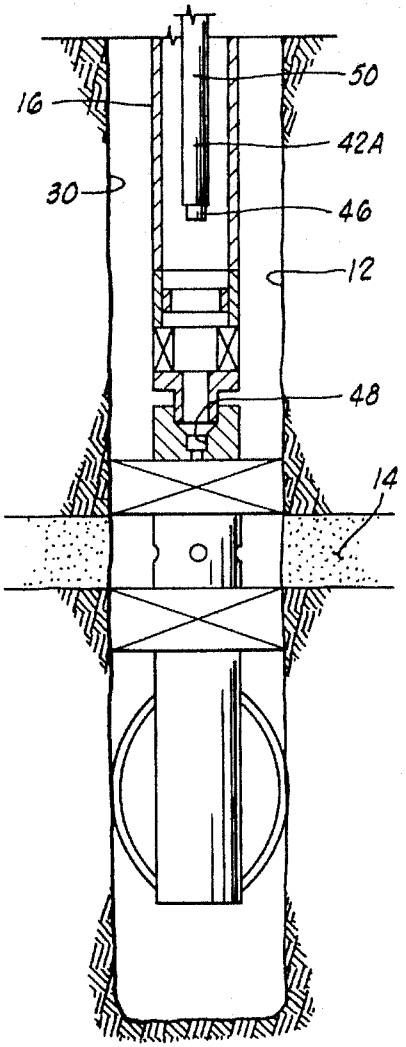
Figure 2A:
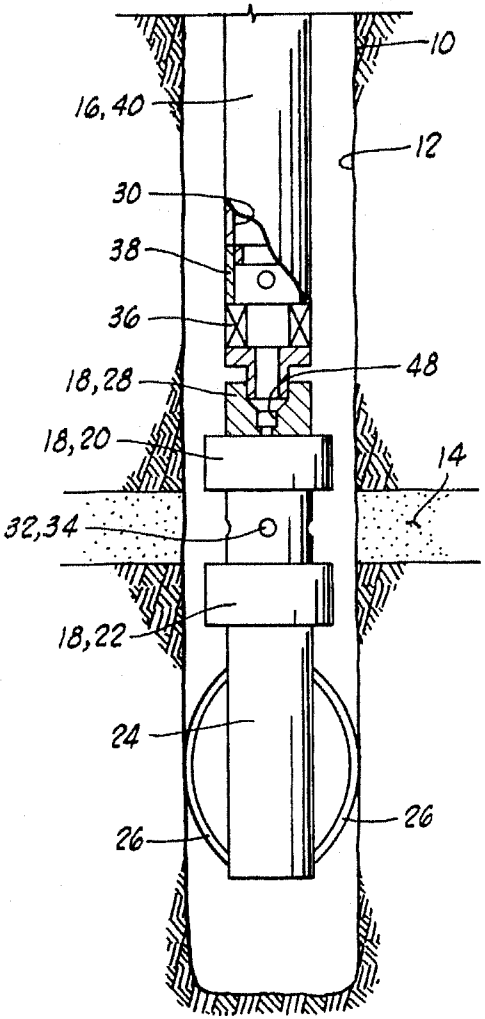

FIGS. 2A–2C comprise a similar sequential series of schematic sketches wherein the wireline conveyed inner well tool 42 has been replaced by a modified inner well tool 42A which is defined on the lower end of inner coiled tubing string 50. In this embodiment when the stinger 46 is engaged with the seal bore 48 as illustrated in FIG. 2C, fluid from the subsurface formation 14 can be flowed upward through the coiled tubing string 50 to a surface location. Also, treatment fluids can be pumped down through the coiled tubing 50 into the subsurface formation 14. The details of construction of this embodiment are further illustrated in FIGS. 7 and 8.

Detailed Description Of The Embodiment Of FIGS. 3–6

FIGS. 3A–3J comprise an elevation right-side only sectioned view of the straddle packer assembly 18 in an initial positions with the inflatable elements 20 and 22 deflated or retracted as they would be when the outer tubing string 16 is first run into a well as schematically illustrated in FIG. 1A.

The straddle packer assembly 18 includes an outer housing assembly 52 made up of an upper collar 54, an oil chamber housing section 56, a load shoulder housing section 58, a packer mandrel section 60, an adapter section 62, the lower housing 24 which carries belly spring 26, and a lower plug 64. All of the components of outer housing assembly 52 are connected together by threaded connections with appropriate O-ring seals as shown.

The packer assembly 18 further includes an inner sliding mandrel 66 having an upper adapter 68 connected to the upper end thereof. The up,per adapter 68 has a female thread 70 for connection of the packer assembly 18 to the various components of tubing string 16 located thereabove such as for example the position correlation sub 36 schematically illustrated in FIG. 1A.

The sliding mandrel 66 includes a cylindrical outer surface 72 which is closely and slidably received within a bore 74 of upper collar 54.

Figure 12:
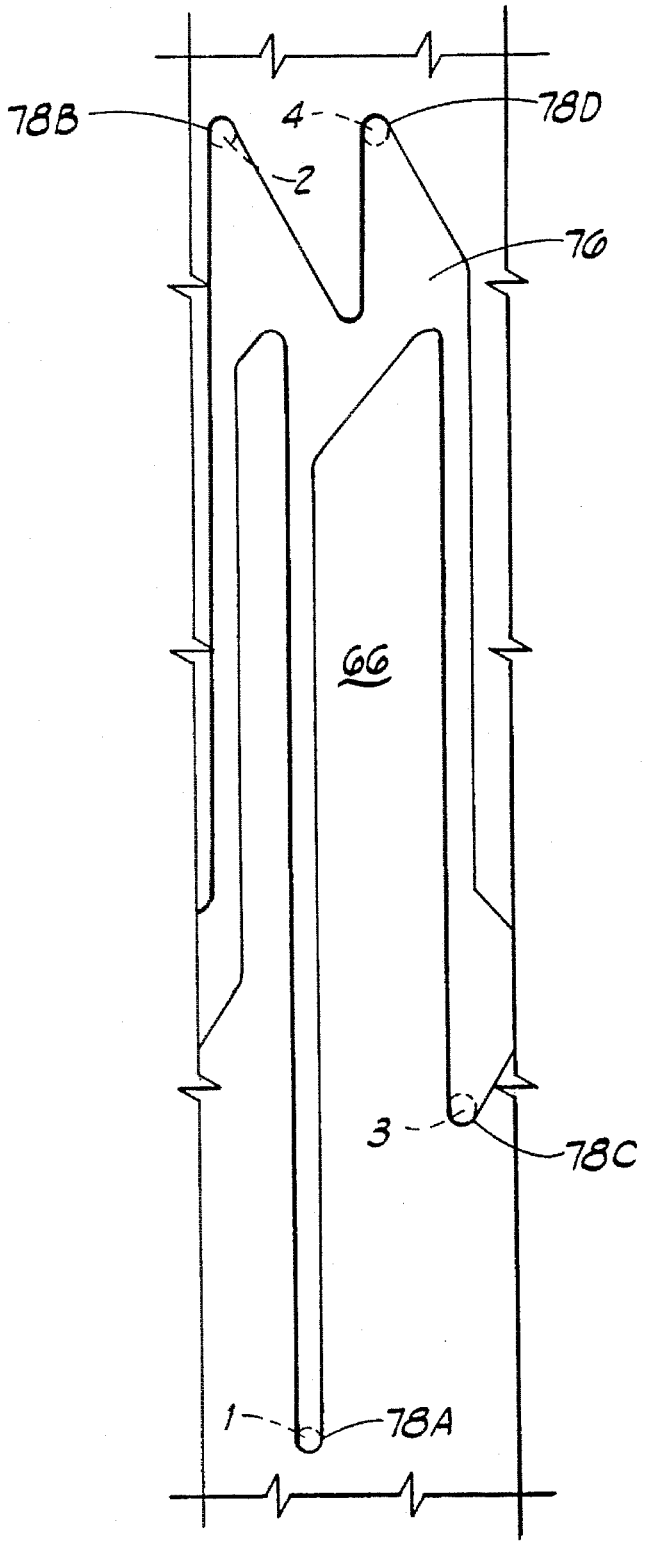
FIG. 12 is a laid-out view of a J-slot of the apparatus of FIGS. 3A–3J. This J-slot controls the opening and closing of an inflation passage so that the inflation and deflation of the packers can be controlled by manipulation of the outer tubing string to which the packers are attached.

As will be further described below, the sliding mandrel 66 slides relative to the outer housing assembly 52 in a sequence controlled by an endless J-slot 76 cut in the outer surface of sliding mandrel 66, and one or more lugs such as 78 carried by the outer housing assembly 52 and received in the endless J-slot 76. A laid-out view of J-slot 76 is shown in FIG. 12.

The movement of sliding mandrel 66 relative to housing assembly 52 is made possible by the belly springs 26 which frictionally engage the uncased borehole 12 to hold the housing assembly 52 fixed relative to borehole 12 as the outer tubing string 16 is physically manipulated from the surface.

Figure 3A:
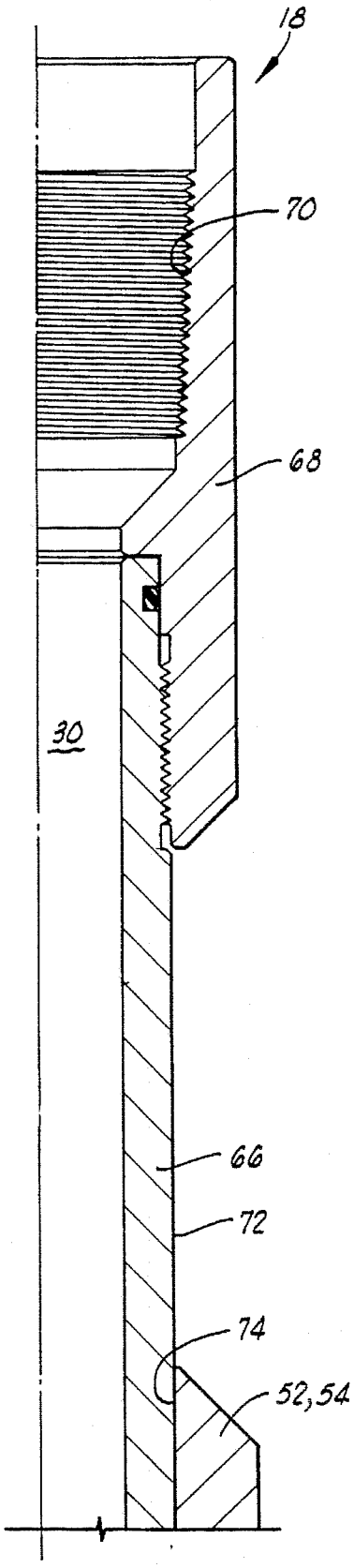
FIGS. 3A–3J comprise an elevation sectioned view showing the details of construction of a surge chamber and straddle packer assembly like that schematically illustrated in FIG. 1A. The assembly is in a position with the packers retracted as it would be in when being run into place in the well as represented in FIG. 1A.
Figure 3B:
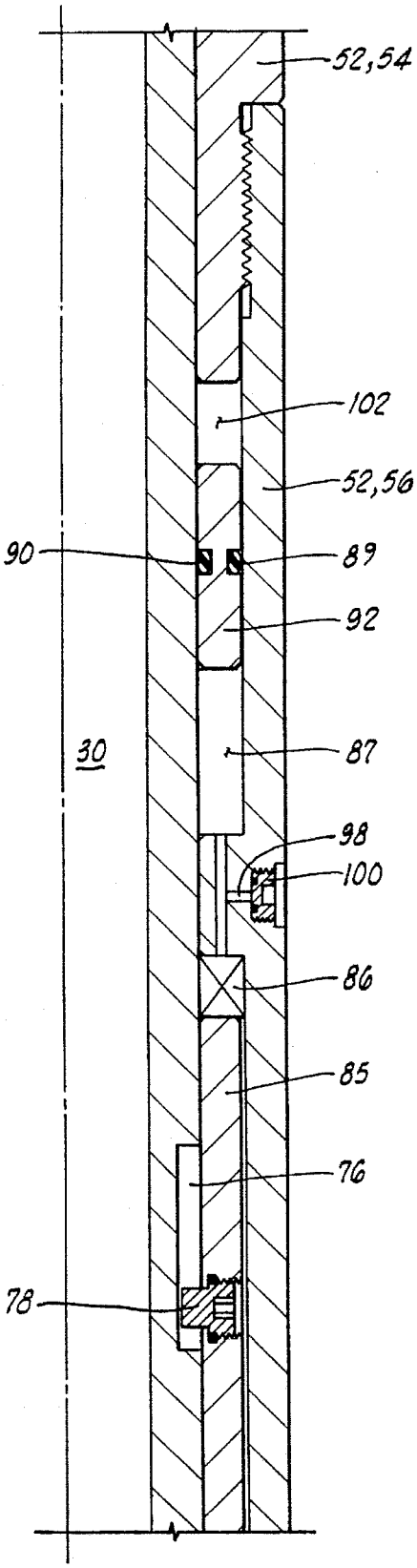
Figure 3C:
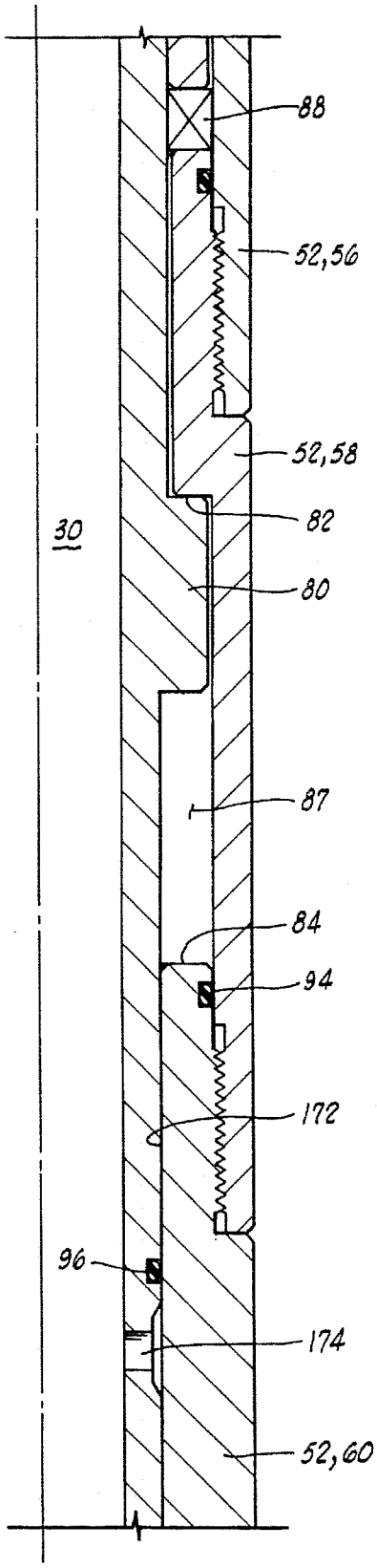

Also, the extreme positions of sliding mandrel 66 relative to housing assembly 54 and the load transferring positions are defined by engagement of a large radially outward extending annular load shoulder 80 defined on sliding mandrel 66 which can abut downward and upward facing load transfer surfaces 82 and 84 of housing assembly 52 as seen in FIG. 3C.

The lugs 78 are carried by housing assembly 52 on a rotatable lug sleeve 85 received between upper and lower bearings 86 and 88.

The J-slot and lugs 76, 78 and the load transfer shoulder 80 all operate in a clean, lubricated environment defined by an oil chamber 87 which extends from seals 89 and 90 of a floating piston 92 at the upper extremity to seals 94 and 96 at the lower extremity. The oil chamber 87 may be filled with oil through a port 98 which is closed by plug 100. The floating piston 92 has an air chamber 102 located thereabove and allows for expansion and contraction of the oil in oil chamber 87.

When the straddle packer assembly 18 is first lowered into the well 10, it is in its extended most position with the annular load transfer shoulder 80 abutting the downward facing load transfer surface 82.

With reference to FIGS. 3E–3H, it is noted that the upper inflatable element 20 has a fixed upper shoe 102 fixedly attached to housing assembly 52 at thread 104. The lower end of upper packer element 20 is bonded to a sliding shoe 106 which is in turn connected at threaded connection 108 to a sliding packer sleeve 110 which has its lower end connected at thread 112 to an upper sliding shoe 114 of lower packer element 22. The lower packer element 22 is bonded at its lower end to a lower sliding shoe assembly 116 which carries O-ring seals 118 and 120 which sealingly and slidingly engage a cylindrical outer surface 122 of packer mandrel 60.

Figure 3D:
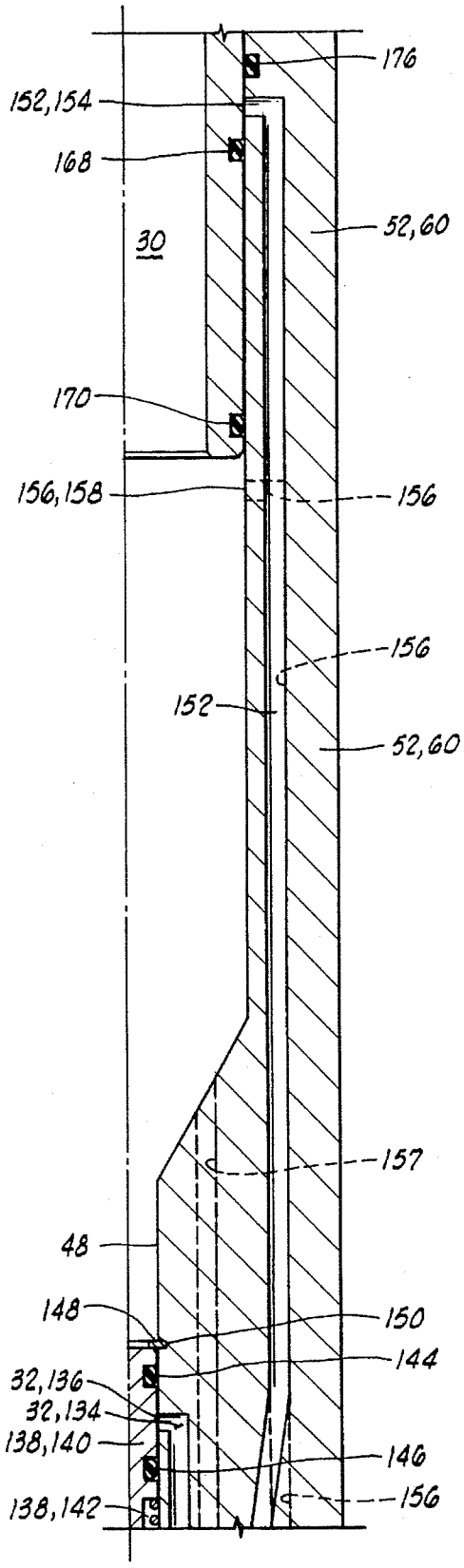
Figure 3E:
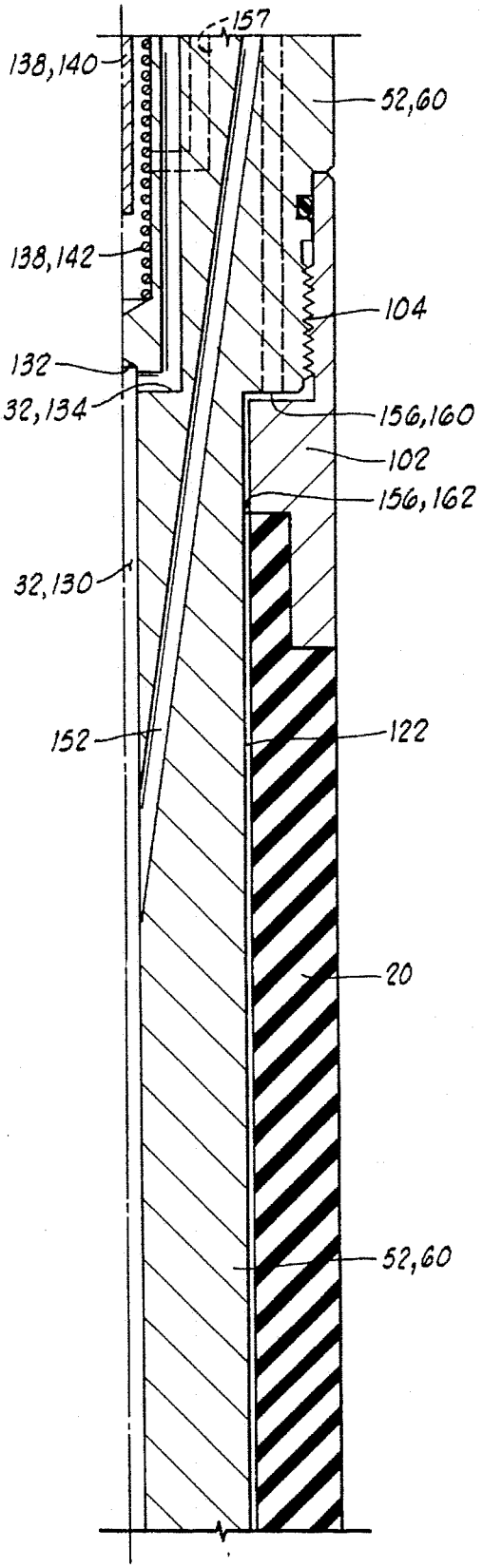
Figure 3F:
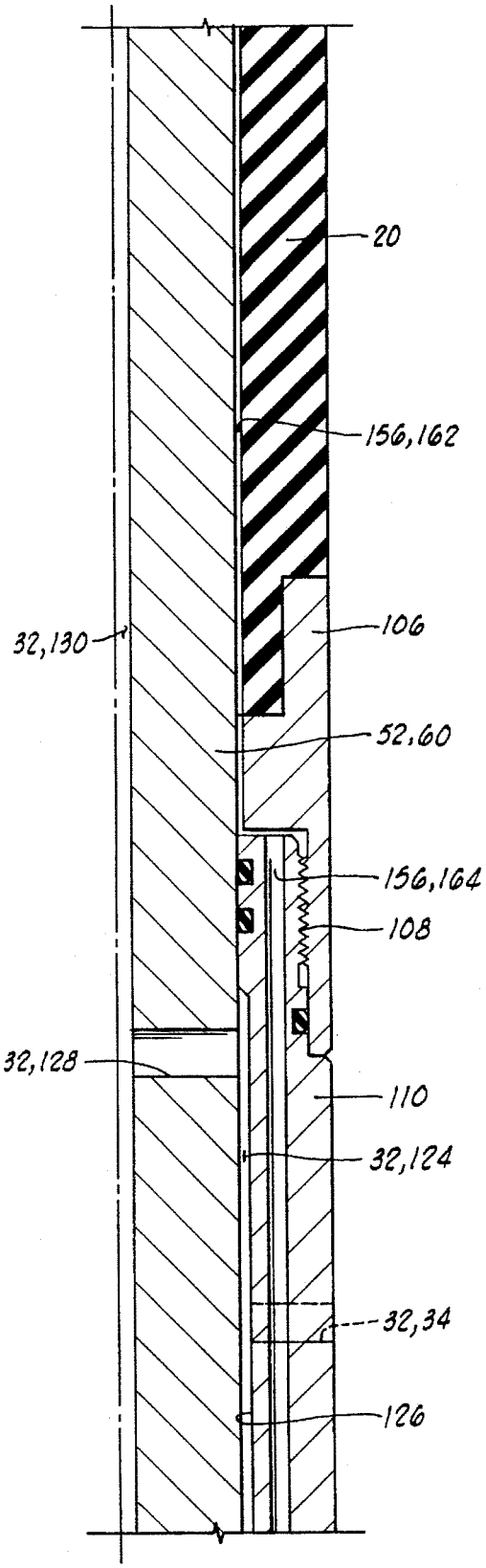

The ports 34 of communication passage 32 previously briefly described with regard to FIG. 1A, are defined in the sliding packer sleeve 110 as shown in FIG. 3F. The communication passage 32 further includes a thin annular space 124 defined between the outer surface 122 of packer mandrel 60 and a cylindrical inner surface 126 of sliding packer ring 110.

Communication passage 32 further includes a plurality of intermediate radial bores 128 which communicate the annular space 124 with a longitudinal bore 130 defined in packer mandrel 60 and having a blind upper end 132. Adjacent the blind end 132 the communication passage 32 includes an offset portion 134 which communicates with a plurality of radially inwardly open ports 136 (see FIG. 3D) defined in the seal bore 48.

A communication valve 138 is located in the seal bore 48 for controlling flow of fluid through the communication passage 32 just described. The communication valve 138 includes a valve element 140 which is biased upwardly by a valve spring 142. Valve element 140 carries upper and lower O-ring seals 144 and 146. The uppermost position of valve element 140 is defined by abutment thereof with a snap ring 148 received in a groove 150 cut into the seal bore 48.

When the valve element 140 is biased by spring 142 to its uppermost position as shown in FIGS. 3D–3E, the upper and lower O-rings seals 144 and 146 are located above and below the port 136 of communication passage 32 as seen in FIG. 3D, thus maintaining the communication passage 32 closed so that there is no fluid flow therethrough.

As is further described below in connection with FIGS. 5A–5E, when the inner well tool 42 is lowered into engagement with the outer tubing string 16 as schematically illustrated in FIG. 1C, the stinger 46 of inner well tool 42 will engage the communication valve 138 thus pushing it downwardly so that O-ring 144 moves below port 136 thus opening the communication passage 32 to provide communication of the subsurface formation 14 with the inner well tool 42.

As seen in FIG. 3E, the longitudinal bore 130 of communication passage 32 is intersected by a diagonally oriented equalizing passage 152 which has an equalizing port 154 defined at its upper end as seen in FIG. 3D. As is further explained below with regard to FIGS. 6A–6E, the equalizing passage 152 is used to equalize fluid pressure between the interior 30 of tubing string 16 and the well annulus 39 sealed between upper and lower packer elements 20 and 22 prior to deflation of the packer elements and retrieval of the tubing string 16.

A fluid relief passage 157 communicates seal bore 48 below lower O-ring 146 with the interior 30 of tubing string 16 located thereabove so as to prevent hydraulic blocking of movement of the valve member 140.

The inflatable packer elements 20 and 22 are communicated with the interior 30 of tubing string 16 by an inflation passage 156 which begins at its upper end at a radially inwardly open inflation port 158 (see FIG. 3D) and then extends longitudinally downward through the packer mandrel 60 to terminate in a lower port 160 which communicates with a thin annular space 162 defined between packer mandrel 60 and upper packer element 20. The thin annular space 162 in turn communicates with a longitudinal passage 164 defined through sliding packer sleeve 110 which communicates with another thin annular space 166 defined between packer mandrel 60 and lower packer element 22.

As is apparent in viewing FIG. 3D, sliding movement of the sliding mandrel 66 relative to the housing assembly 52 will determine whether the inflation passage 156 is opened or closed. It will similarly determine whether the equalizing passage 152 is opened or closed.

The sliding mandrel 66 carries first, second and third seals 96, 168 and 170, respectively, which are sealingly received within a bore 172 of packer mandrel 60. Sliding mandrel 66 further includes a plurality of equalizing ports 174 defined therethrough between the first and second seals 96 and 168. The packer mandrel 60 carries an O-ring 176 located immediately above the equalizing port 154.

When the sliding mandrel 66 is in its initial uppermost position relative to housing assembly 52 as illustrated in FIGS. 3A–3D, and as defined by abutment of the load transfer shoulder 80 with the downward facing load transfer surface 82, the equalizing passage 152 is closed and the inflation passage 156 is opened as seen in FIG. 3D.

Figure 3G:
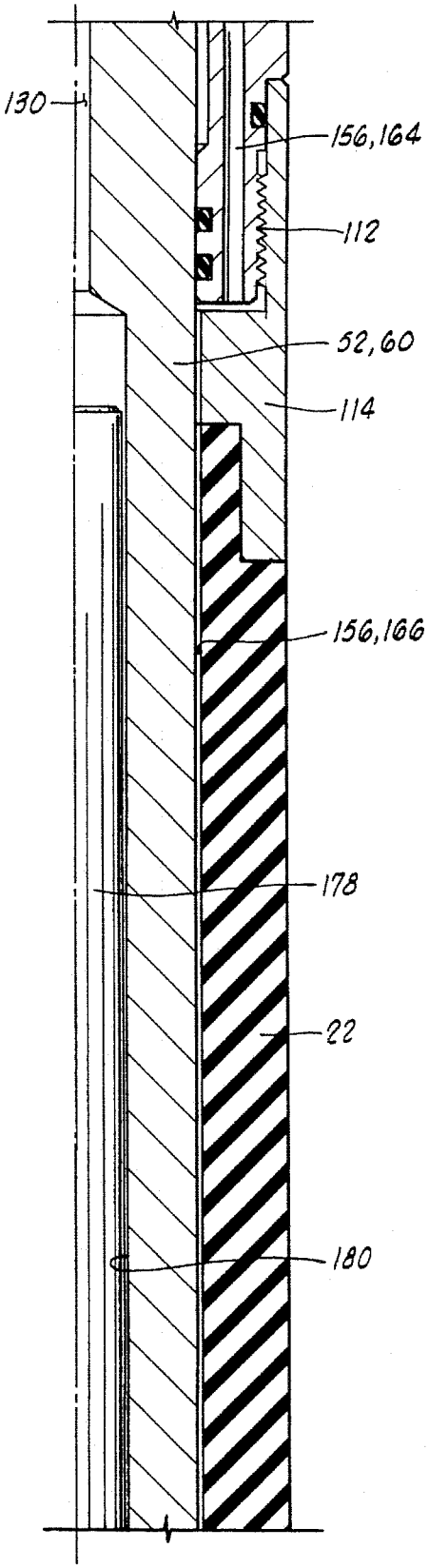
Figure 3H:
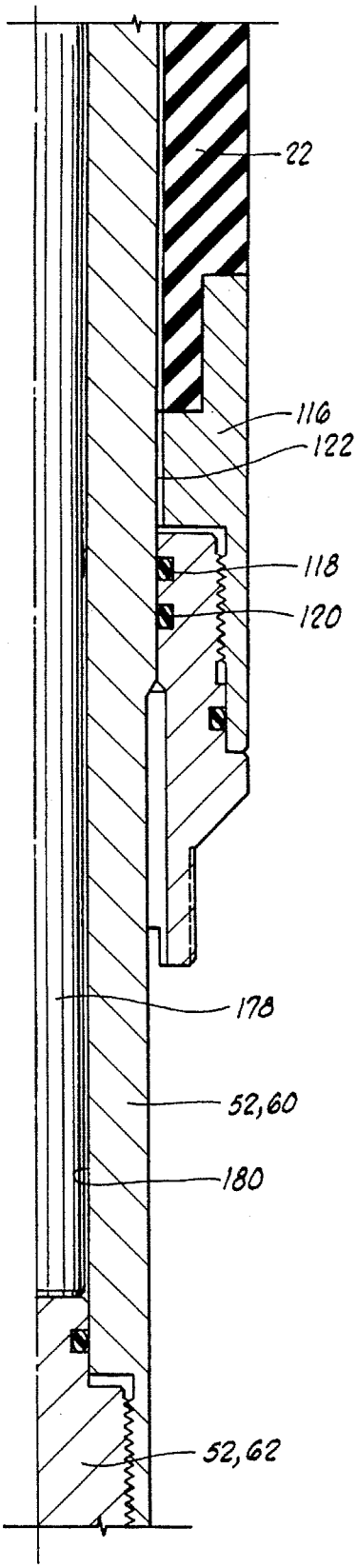
Figure 3I:
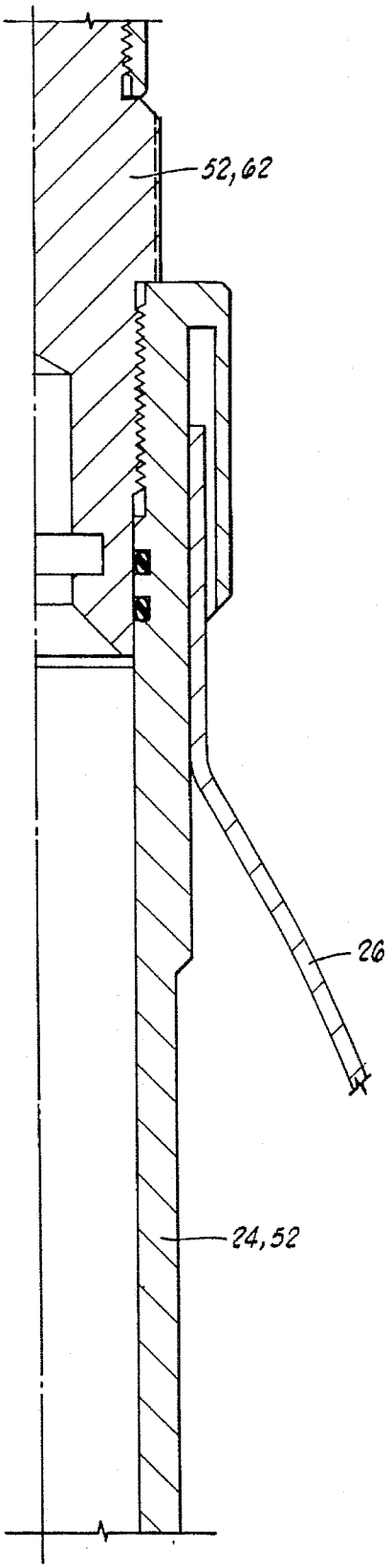
Figure 3J:
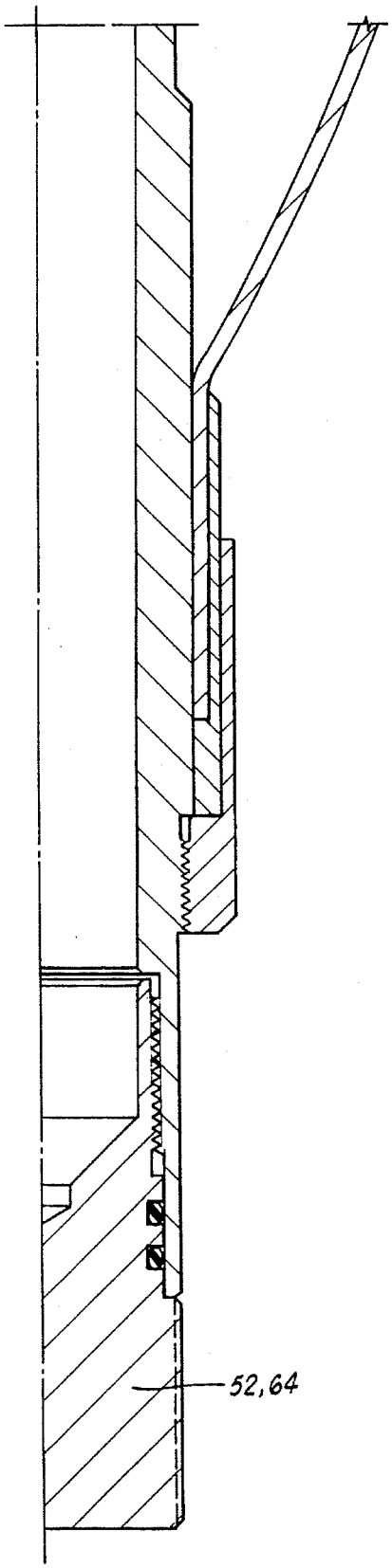

As seen in FIGS. 3G and 3H, an electronic gauge carrier 178 which is cylindrical in shape is received within a lower bore 180 of packer mandrel 60 and communicates through the longitudinal bore 130 with the communication passage 32. The electronic gauge carrier 178 includes sensing devices such as pressure and temperature sensors which monitor and record the pressure and temperature of the well fluids which flow through the communication passage 32 when the inner well tool 42 is communicated with formation 14 as further described below. The electronic gauge carrier 178 may for example be a HMR tool available from Halliburton Company. The details of construction of such a downhole gauge carrier may be as shown in U.S. Pat. No. 4,866,607 to Anderson et al., the details of which are incorporated herein by reference.

When the outer tubing string 16 is located in the position such as schematically illustrated in FIG. 1A with the upper packer element 20 located above the subsurface formation 14 and with the lower packer element 22 located below the subsurface formation 14, the packer elements 20 and 22 can be inflated. The circulating valve 38 must be closed and then by increasing fluid pressure in the interior 30 of outer tubing string 16 approximately 800 to 1000 psi that pressure is transmitted through the open inflation passage 156 as seen in FIGS. 3A–3H to inflate the inflatable packer elements 20 and 22 thus setting them in the uncased borehole 12 as schematically illustrated in FIG. 2B.

In the detailed drawings of FIGS. 4A–4E, the upper packer element 20 is shown in an inflated position and the inflation passage 156 has now been closed to trap the inflation pressure in the inflatable elements 20 and 22. The inflation passage 156 is closed by moving the sliding mandrel 66 downward relative to housing assembly 52 in the following manner.

Figure 4A:
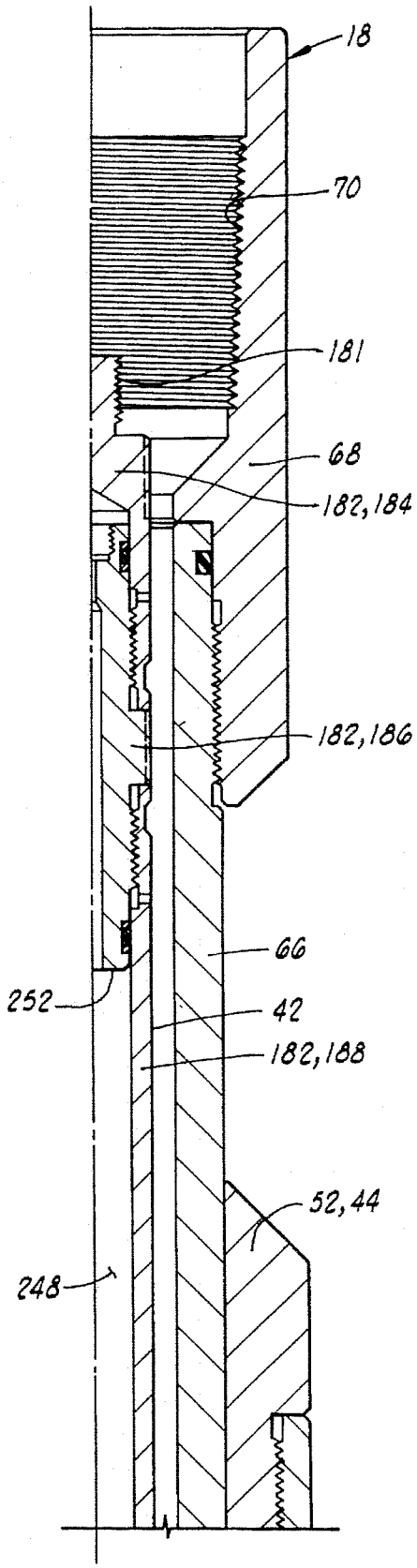
In FIGS. 4A–4E, the packers have been inflated to set them within the uncased borehole as also schematically illustrated in FIG. 1B.
Figure 4B:
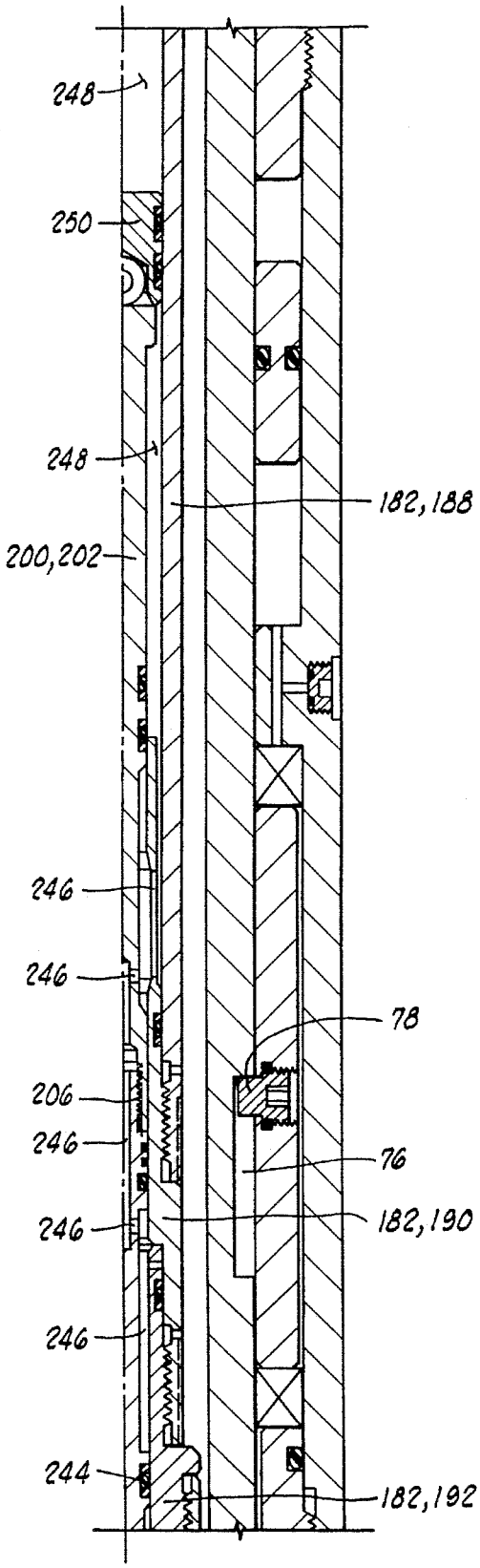
Figure 4C:
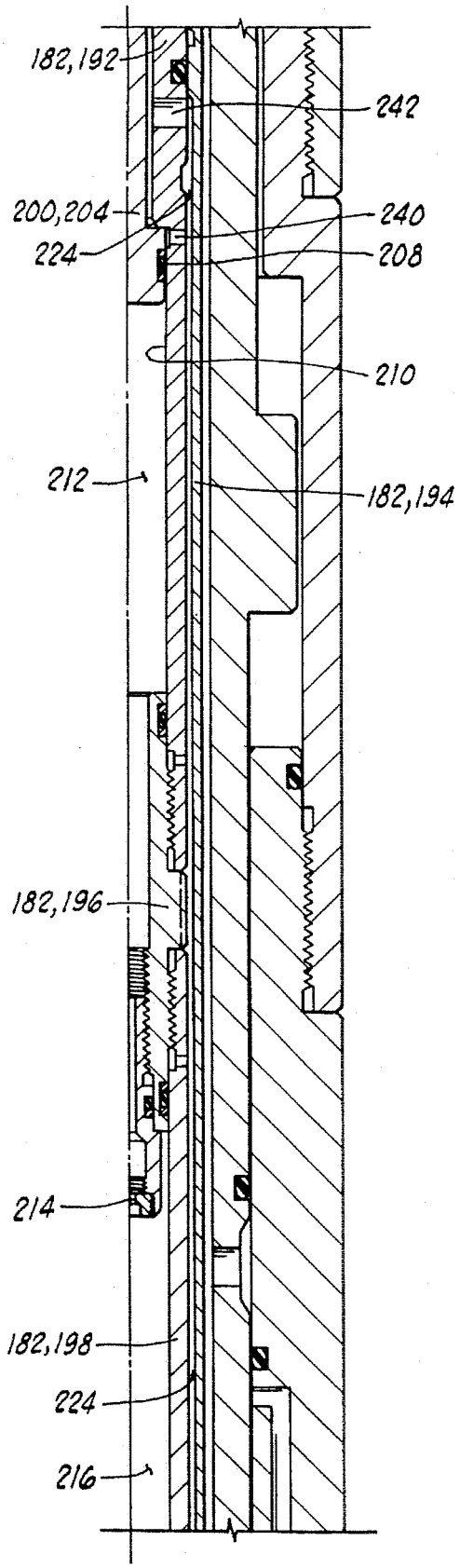
Figure 4D:
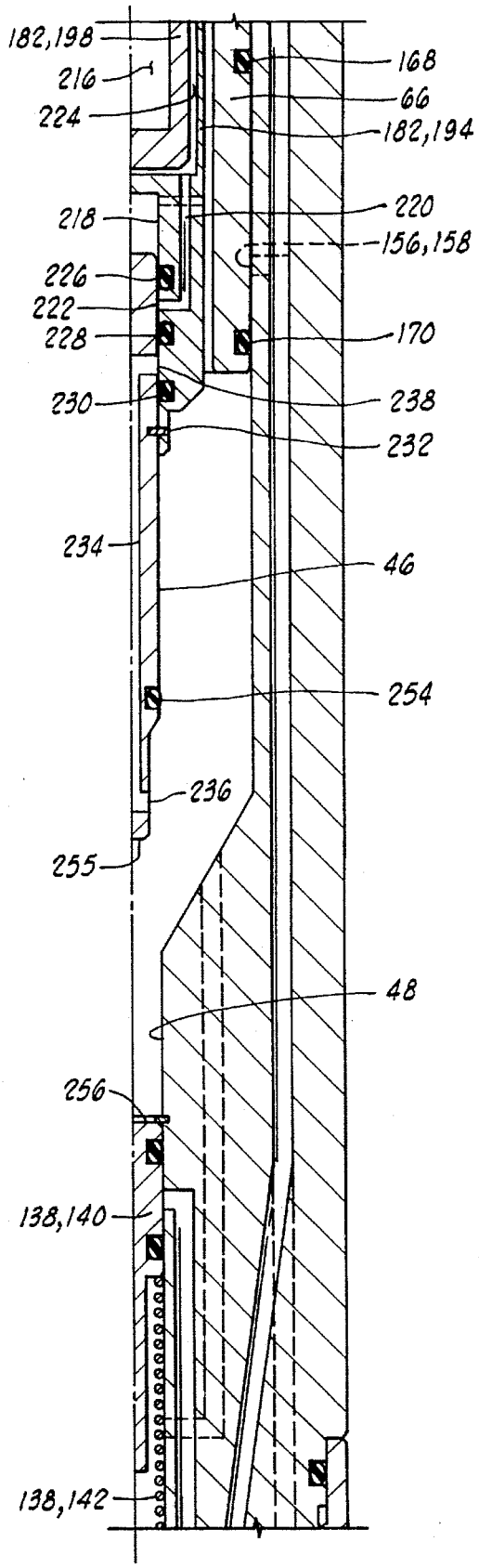
Figure 4E:
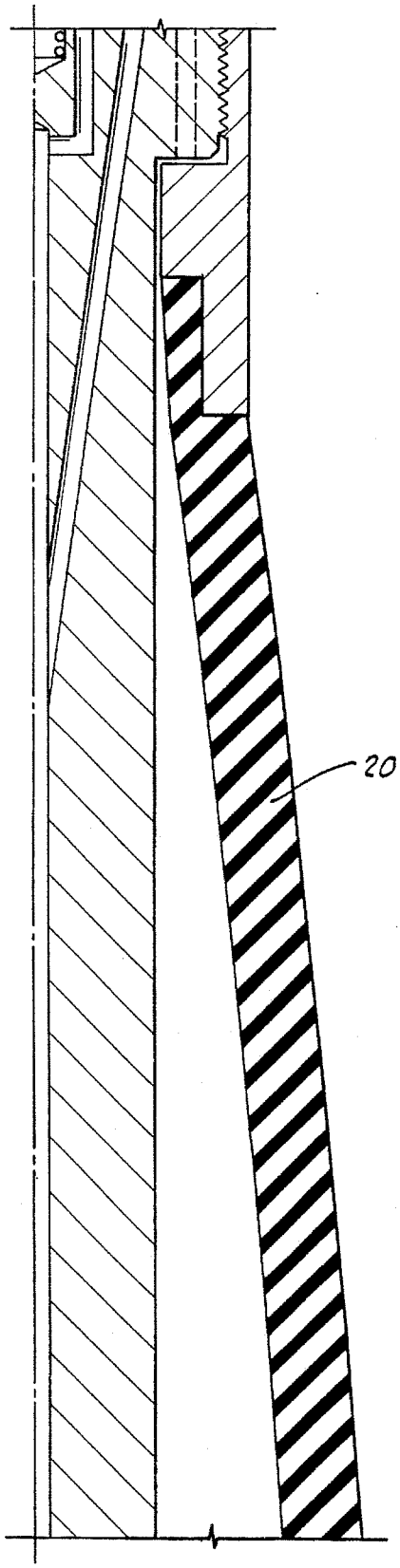

FIGS. 4A–4E illustrate the upper portions of packer assembly 18 as just described with regard to FIGS. 3A–3E after the outer tubing string 16 has been manipulated to move the sliding mandrel 66 to a lower position relative to housing assembly 52 as defined by movement of lugs 78 to an upper position within J-slot 76 as seen in FIG. 4B. As seen in FIG. 4D, this moves the lowermost seal 170 of sliding mandrel 66 to a position below the ports 158 of inflation passage 156 to close inflation passage 156. The lower portions of the packer assembly 18 are the same as shown in FIGS. 3F–3J.

After the inflation passage 156 has been closed off as shown in FIG. 4D, the circulating valve 38 can be reopened if desired to allow continuing circulation of well fluids through the well annulus 39 to prevent differential sticking of outer tubing string 16 during the subsequent operations.

After the sliding mandrel 66 has been moved to the position shown in FIGS. 4A–4D, thus trapping inflation pressure in the inflatable elements 20 and 22 so they will remain set within the borehole 12 as schematically illustrated in FIG. 1B, the inner well tool 42 can be lowered on wireline 44 into the outer tubing string 16 as also schematically illustrated in FIG. 1B.

In FIGS. 4A–4D, the inner well tool 42 is shown partially lowered into position within the packer assembly 18 of outer tubing string 16 as was schematically illustrated in FIG. 1B. The stinger 46 has not yet been engaged with the seal bore 48 as can be seen in FIG. 4D.

The inner well tool 42 shown in FIGS. 4A–4D is a surge tool 42. A threaded connection 181 at the upper end of surge tool 42 allows connection thereof to the wireline 44 in a known manner. The wireline 44 is not illustrated in FIG. 4A.

The surge tool 42 includes a surge tool housing assembly 182 which is made up of upper connector 184, adapter 186, sample housing 188, upper valve housing 190, lower valve housing 192, lower surge tool housing shell 194, orifice housing 196, and dump chamber housing 198.

A sliding sample valve assembly 200 having upper and lower parts 202 and 204 threadedly connected at thread 206 is slidably received within the surge tool housing assembly 182.

Lower part 204 of sliding valve sleeve assembly 200 includes an enlarged diameter portion carrying an O-ring seal 208 which is sealingly received within a bore 210 of lower valve housing 192.

Located below the sliding valve sleeve assembly 200 and particularly below O-ring 208 is an oil-filled oil chamber 212. As is further described below, downward movement of sliding sample valve assembly 200 is slowed due to the time required to force the oil from oil chamber 212 through an orifice 214 into an empty dump chamber 216 defined in dump chamber housing 198.

The lower surge tool housing shell 194 has a lower inner bore 218 within which the stinger member 46 is slidably received as seen in FIG. 4D. Lower surge tool housing shell 194 has a surge passage 220 defined therein which has a port 222 at its lower end communicated with bore 218 and which is communicated at its upper end with a thin annular space 224 defined between lower surge tool housing shell 194 on the outside and dump chamber housing 198, orifice housing 196, and lower valve housing 192 on the inside.

First, second and third O-ring seals 226, 228 and 230 are located in the bore 238 of lower surge tool housing shell 194. The port 222 is located between first and second O-ring seals 226 and 228. The stinger 46 is held in an initial position shown in FIG. 4D by a plurality of shear pins 232. Stinger 46 includes a stinger passage 234 having ports 236 and 238 at its lower and upper ends, respectively. When the stinger 46 is in its initial position, the upper port 238 is located between second and third O-rings 228 and 230 and is thus isolated from port 222 so that fluids cannot flow in through the stinger 46 into the surge tool 42.

The stinger 46 carries an outer O-ring seal 254 which will subsequently be received in the seal bore 48 of packer assembly 18.

The thin annular space 224 is communicated with first and second power ports 240 and 242 defined through lower valve housing 192 above the O-ring seal 208 of valve member 200. When high pressure formation fluids are subsequently communicated with the stinger passage 234 in a manner further described below, they will be communicated through the thin annular space 224 to the power ports 240 and 242 thus causing the valve member 200 to begin slowly moving downward within the valve housing 190, 192.

The valve member 200 carries an O-ring seal 244 (see lower portion of FIG. 4B) which after a short movement of valve member 200 will move below the second power port 242. After that time, the second power port 242 serves as a sampling port and will flow a sample of well fluid through an irregularly shaped sampling passage 246 into a sample chamber 248. The details of construction of the sampling passage and associated structure are similar to those shown in U.S. Pat. No. 5,058,674 to Schultz et al., the details of which are incorporated herein by reference.

A floating piston 250 is located above sliding sample valve assembly 200. As the sample chamber 248 fills with well fluid, the floating piston 250 will move upward until it abuts a lower end 252 of adapter 186.

The volume of the sample to be taken can be varied by varying the size of the surge chamber 248.

Turning now to FIGS. 5A–5E, the components of FIGS. 4A–4E are shown in the position wherein the stinger 46 has been stabbed into the seal bore 48 thus placing the upper port 134 of communication passage 32 in communication with the surge passage 220 through the stinger 46. This is accomplished in the following manner.

As the stinger 46 is inserted into the seal bore 48, the O-ring seal 254 will be sealingly received in the seal bore 48. A lower end 255 of stinger 46 will abut an upper end 256 of communication valve element 140 thus compressing valve spring 142 and moving the communication valve element 140 downward to the position shown in FIG. 5D wherein the upper port 134 of communication passage 132 is uncovered. The valve element 140 bottoms out in seal bore 48, and then the shear pins 232 which initially held stinger 46 in place relative to lower surge tool housing shell 194 will shear thus allowing the stinger 46 to move upward within bore 218 to the position shown in FIG. 5D wherein the stinger passage 234 is communicated with the port 222 of surge passage 220 thus placing the surge passage 220 in fluid communication with the subsurface formation 14 through the communication passage 32.

Then, as previously described, well fluid will flow upward through the thin annular space 224 and in through power ports 240 .and 242 to begin pushing the sample valve assembly 200 downward. This downward movement is controlled by the metering of oil from orifice chamber 212 through orifice 214 into dump chamber 216. When seal 244 of sample valve assembly 200 moves below power port 242, that well fluid will then flow through the power port 242 and through the irregularly shaped sampling passage 246 into the sample chamber 248 below floating piston 250. The sample chamber 248 will fill relatively quickly until the floating piston 250 has moved upward into abutment with lower end 252 of adapter 186. This will be accomplished long before the downward sliding movement of sample valve member 200 has been completed. The sample valve member 200 will move downward until downward facing shoulder 258 abuts an upper end 260 of upper valve housing 190. At this time, O-rings 264 and 266 will have moved below slotted ports 268 of sampling passage 246 to trap the sample within sample chamber 248.

The sampling tool or surge tool 42 can then be retrieved with the wireline 44 thus retrieving the sample to the surface. When the sample chamber 42 is pulled out of engagement with the seal bore 48, the valve spring 142 will move the communication valve 140 back up to its closed position of FIG. 4D.

If it is desired to take additional samples, additional surge tools 42 can be lowered into engagement with the seal bore 48 in a like manner.

Also, a pump could be incorporated into the surge chamber 42 to artificially produce the subsurface formation 14. This can also be utilized to insure that a clean well fluid sample is taken.

When it is desired to move the outer tubing string 16 to another location in the well or to retrieve it from the well, the pressure in interior 30 of outer tubing string 16 should first be balanced with the pressure trapped in the well annulus 39 between the upper and lower packer elements 20 and 22.

When the formation 14 is tested, the pressure between the packers 20 and 22 drops as it surges into the sample chamber. The equalizing position increases the pressure between the packers to make it more nearly equal to the hydrostatic pressure present in the annulus above and below the packers. This is accomplished by physical manipulation of the outer tubing string as controlled by J-slot and lug assemblies 76, 78 to move the sliding mandrel 66 to a position as shown in FIGS. 6A–6D wherein equalizing ports 174 are moved below O-ring seal 176 so as to place equalizing passage 152 in fluid communication with interior 30 of outer tubing string 16.

After that pressure has equalized, the sliding mandrel 66 can be pulled upward by tubing string 16 to return to the position shown in FIGS. 3A–3J thus allowing the packer elements 20 and 22 to deflate so that the outer tubing string is again in a position as illustrated in FIG. 1A and can be moved to another location within the borehole 12 or retrieved from the well 10.

The J-Slot And Lug Of FIG. 12

In FIG. 12, a laid-out view is shown of the J-slot 76 and lug 78, illustrating the various positions of the lug 78 within the J-slot 76. The lug 78 is in a first position 78A when the sliding mandrel 66 is in its initial uppermost position relative to the housing assembly 52 as illustrated in FIGS. 3A–3D whereby the inflation elements 20 and 22 of the packer 18 are deflated. After the inflation elements 20 and 22 are inflated, the sliding mandrel 66 is moved to its lowermost position relative to the housing assembly 52 as illustrated in FIGS. 4A–4E. When the sliding mandrel 66 is moved to its lowermost position, the lug 78 is in its second position 78B and inflation pressure is trapped within the inflation elements 20 and 22. Prior to deflating the inflation elements 20 and 22, the sliding mandrel 66 is moved to an intermediate position whereby the lug 78 is in a third position 78C and whereby the fluid pressure between the interior 30 of the tubing string 16 and the well annulus 39 sealed between the inflated packer elements 20 and 22 is allowed to equalize by way of the diagonal equalizing passage 152. After such equalization, the sliding mandrel 66 is again moved to its lowermost position whereby the lug 78 is in a fourth position 78D, the equalization passage 152 is closed and the packer elements remain inflated. Finally, the sliding mandrel 66 is moved to its uppermost position whereby the lug 78 returns to its first position 78A and the packer elements 20 and 22 are deflated.

Details Of Construction Of The Embodiment Of FIGS. 7 And 8

Figure 7A:
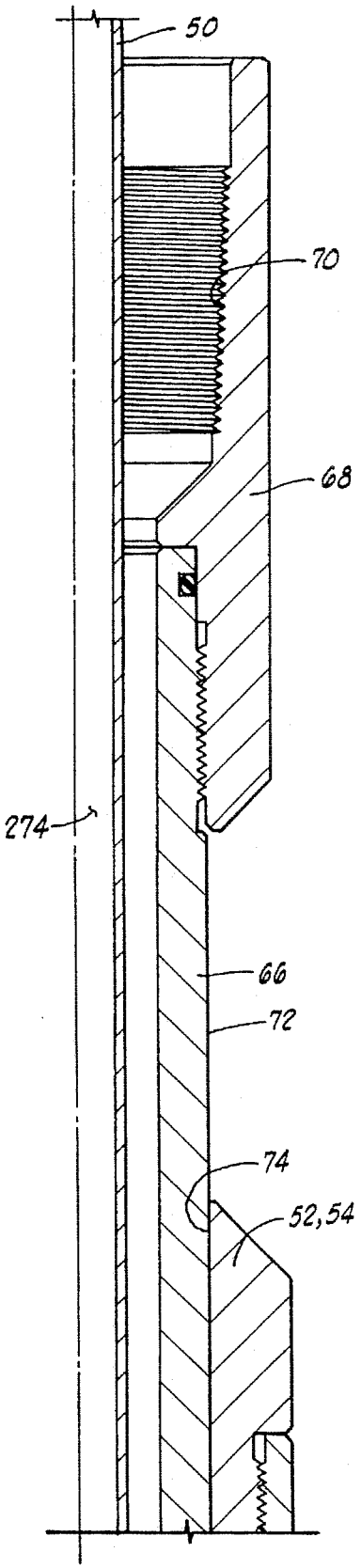
FIGS. 7A–7D comprise an elevation sectioned view of the outer straddle packer assembly as seen in FIGS. 3A–3B with an inner coiled tubing string and valve partially run into place therein in a manner similar to that schematically illustrated in FIG. 2B.
Figure 7B:
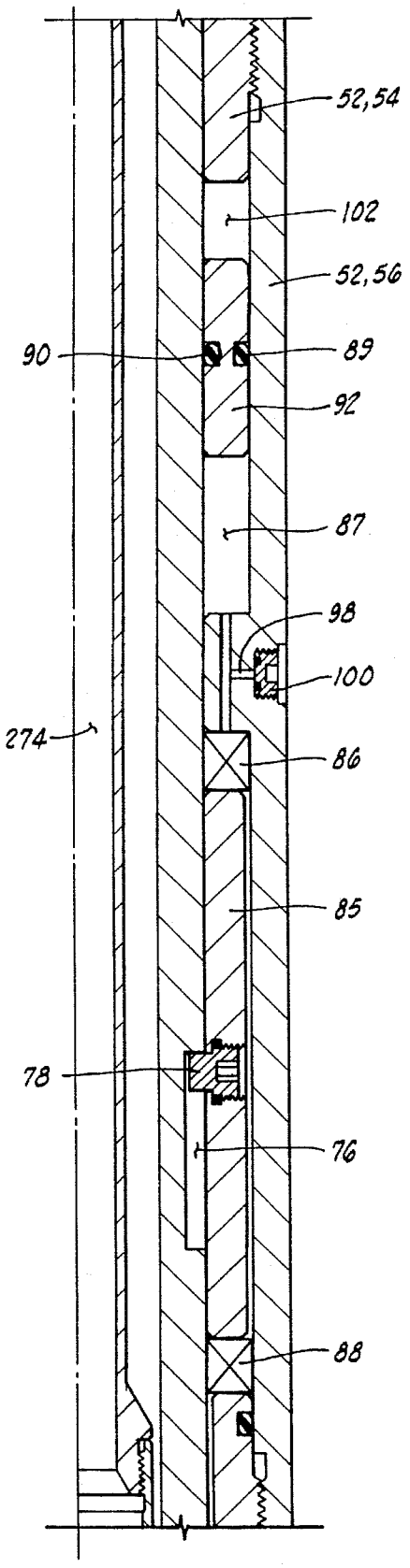
Figure 7C:
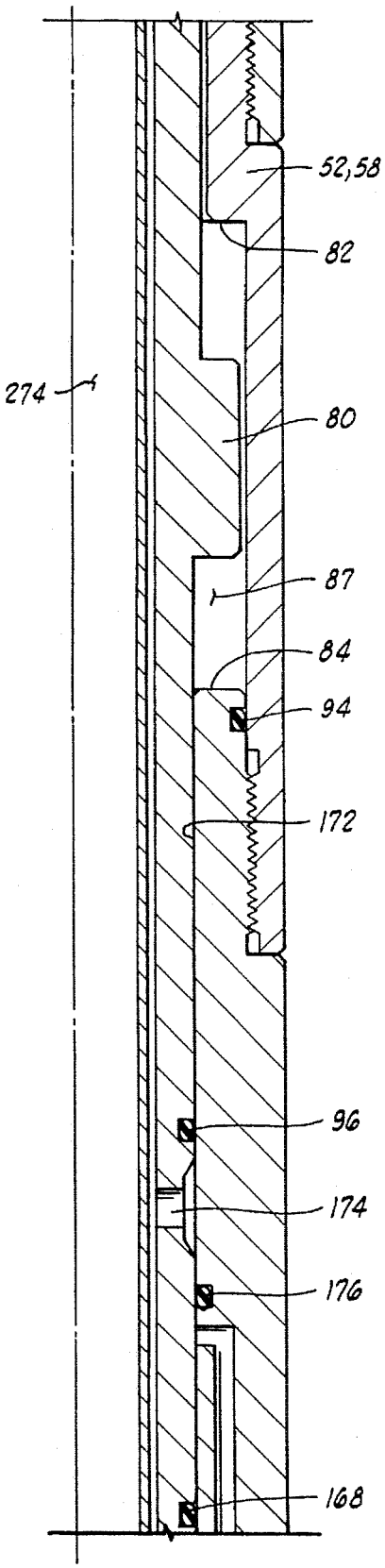
Figure 7D:
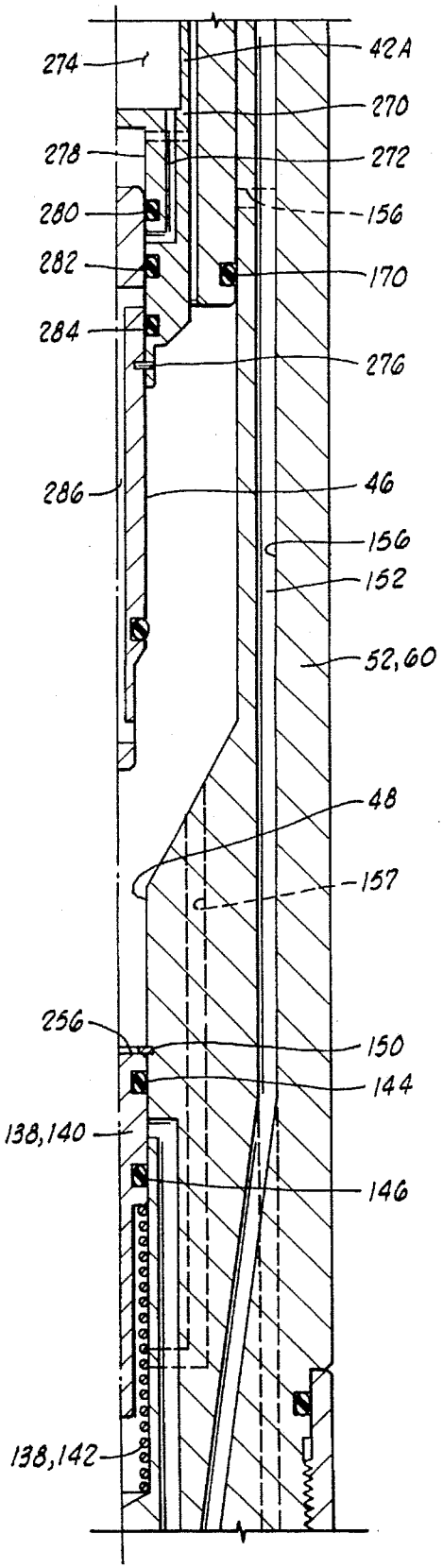

In FIGS. 7A–7D a structure corresponding to that schematically illustrated in FIG. 2B is shown. A coiled tubing string 50 has been partially lowered into the outer tubing string 16 so that the stinger 46 is located just above the seal bore 48 as seen in FIG. 7D. It will be recognized that the stinger 46, seal bore 48 and associated structures shown in FIG. 7D are substantially identical to and in a position analogous to that shown in FIG. 4D and described above. The only difference is that the stinger 46 is now attached to the coiled tubing string 50 rather than to the surge tool 42.

As schematically illustrated in FIG. 2B, the coiled tubing string 50 has a modified inner tool 42A defined on the lower end thereof. This modified inner tool 42A includes a hollow housing 270 constructed similar to the lower portion of the lower surge tool housing shell 194 described above with regard to FIG. 4D.

The hollow housing 270 has a surge passage 272 defined therethrough which is communicated with a coiled tubing bore 274 of coiled tubing string 50.

In the position shown in FIG. 7D, the stinger 46 is held in place in its initial position by shear pins 276 wherein surge passage 272 is closed. The stinger 46 is received in a bore 278 of hollow housing 270 and engages first, second and third O-ring seals 280, 282 and 284. A stinger passage 286 is defined in stinger 46.

Figure 8A:
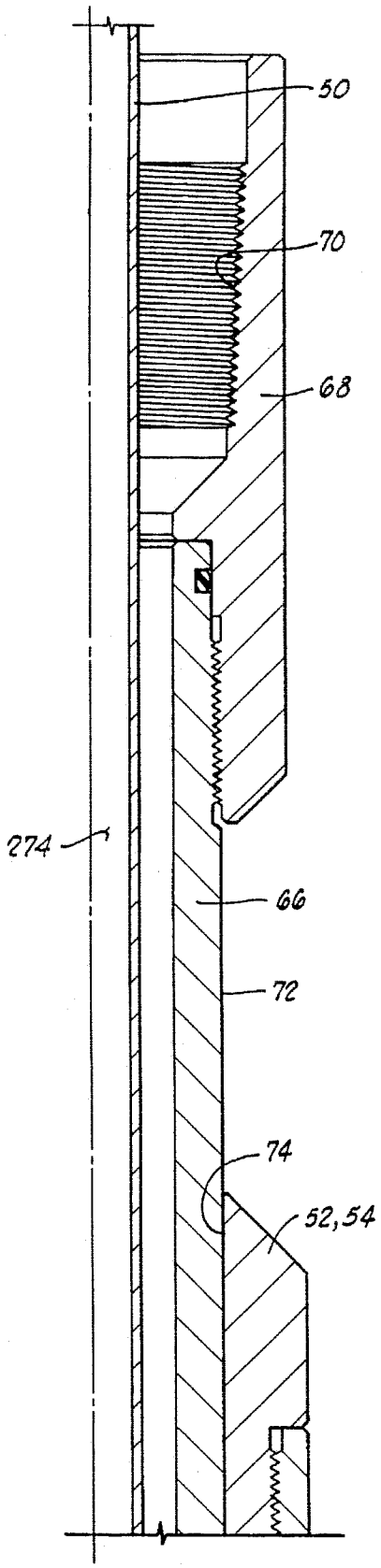
FIGS. 8A–8D illustrate the apparatus of FIGS. 7A–7D with the coiled tubing string engaged with the surge receptacle of the packer assembly so that a well fluid sample can flow up through the coiled tubing string as schematically illustrated in FIG. 2C.
Figure 8B:
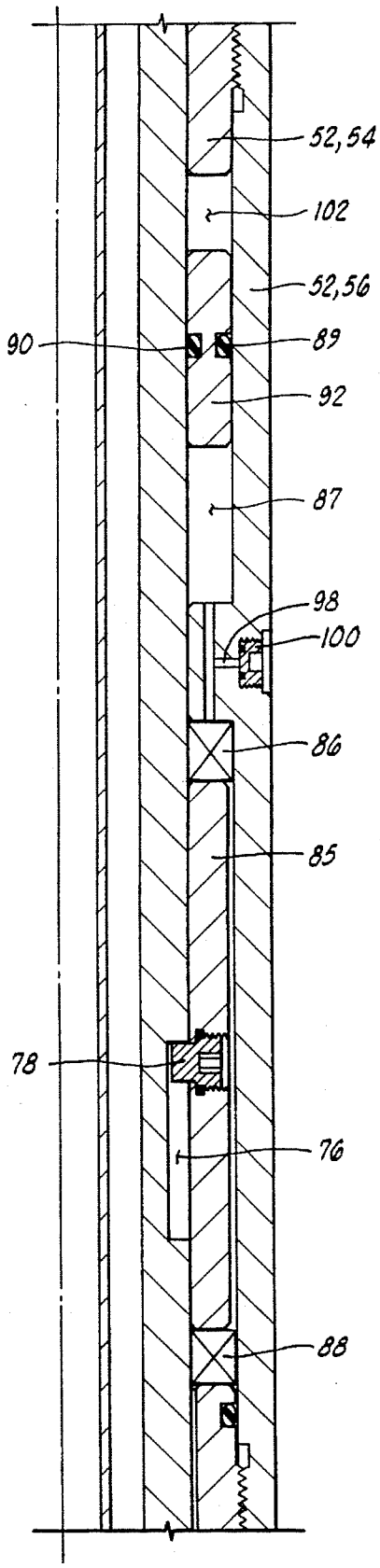
Figure 8C:
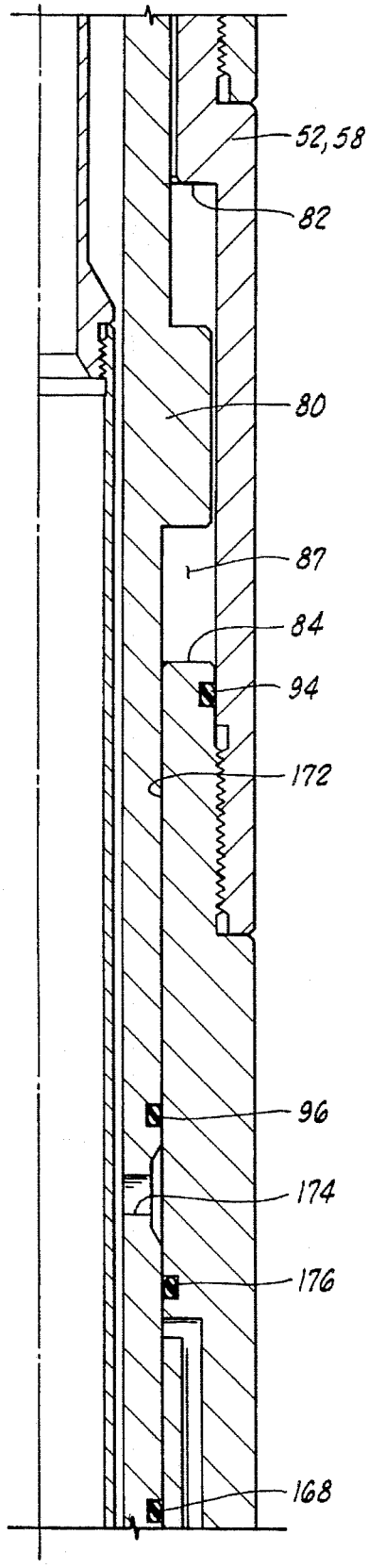
Figure 8D:
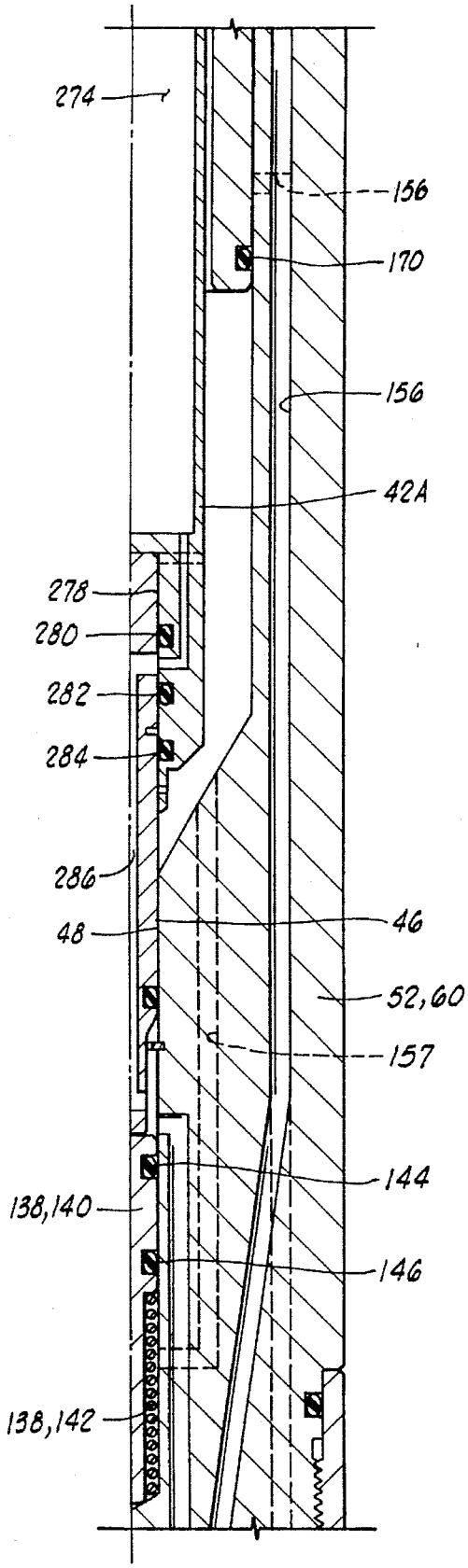

When the stinger 46 is lowered into engagement with the communication valve 140, the communication valve 140 and the stinger 46 are both moved to open positions thus placing the coiled tubing bore 274 in communication with subsurface formation 14 as illustrated in FIG. 8D.

Stinger 46 with stinger passage 286 and the surge passage 272 along with the three O-ring seals 280, 282 and 284 provide a closure valve on the lower end of the coiled tubing string 50 which may be generally referred to as a coiled tubing closure valve. This closure valve is maintained in closed position as shown in FIG. 7D as the coiled tubing is run into the well. After the stinger 46 is engaged with seal bore 48 as illustrated in FIG. 8D, the coiled tubing closure valve is moved to an open position substantially simultaneously with engaging the stinger 46 with the outer tubing string 16 thereby placing the interior of the coiled tubing string 50 in communication with the subsurface formation 14 through the communication passage 32.

Details Of Construction Of The Embodiment Of FIGS. 9 And 10 Utilizing An Injection Canister For Treating The Well FIGS. 9A–9D again show the upper portion of the packer assembly 18 in a position similar to that described above with regard to FIGS. 4A–4E wherein the inflatable elements 20 and 22 have been set in the open borehole 12 in a manner like that schematically illustrated in FIG. 1B. In FIGS. 9A–9D, an inner well tool which is more specifically described as an injection canister 300 is shown partially lowered into the packer assembly. The injection canister 300 would be lowered into place on a wireline 44 just like the inner well tool 42 shown schematically in FIG. 1B.

The injection canister in fact utilizes many of the components of the sampling tool 42 illustrated in FIGS. 4A–4D, but the injection canister 300 operates in a very different manner. The injection canister 300 carries a pressurized fluid such as acid therein which will be injected into the subsurface formation 14 when the injection canister 300 is mated with the seal bore 48 as shown in FIGS. 10A–10D.

The injection canister 300 includes a canister housing assembly 302 made up of an upper connector piece 304, a nitrogen chamber housing 306, an acid chamber housing 308, upper valve housing 310, lower valve housing 312, lower housing shell 314, orifice housing 316, and dump chamber housing 317. An adapter 318 supports orifice valve nosepiece 320 from orifice housing 316. An orifice valve sleeve 322 is slidably received on nosepiece 320.

A sliding valve assembly 324 made up of upper part 326 and lower part 328 is slidably received in the valve housing 310, 312 in a manner identical to that described above with regard to the valve member 200 seen in FIGS. 4B–4C.

An oil chamber 325 is defined in the lower valve housing section 312 below an O-ring seal 326 of sliding valve member 324. The oil chamber 325 is filled with oil down through the interior of orifice housing 316, adapter 318, and a small axial bore 328 of orifice valve nosepiece 320. A small radial port 330 is defined through the wall of nosepiece 320 and communicates with oil chamber 325. In the position shown in FIG. 9C, the orifice valve sleeve 322 is held in place by a shear pin 332 so that the port 330 is blocked by the upper portion of valve sleeve member 322. It is noted that the valve sleeve member 322 has a sleeve port 334 defined therein. In a manner further described below, the orifice valve sleeve 322 is moved upward relative to nose 320 shearing shear pin 332 and moving port 334 into registry with port 330 to allow oil to slowly meter therethrough from the oil chamber 325 into a dump chamber 336 defined in dump chamber housing 317.

Located above and surrounding an upper portion of the valve member 324 above an O-ring 338 is an acid chamber 340 filled with acid or other liquid which is to be injected under pressure into the subsurface formation 14. A floating piston 342 is located in the top of acid chamber 340 and separates the acid in acid chamber 340 from pressurized nitrogen gas or other gas located in nitrogen chamber 344.

Figure 9A:
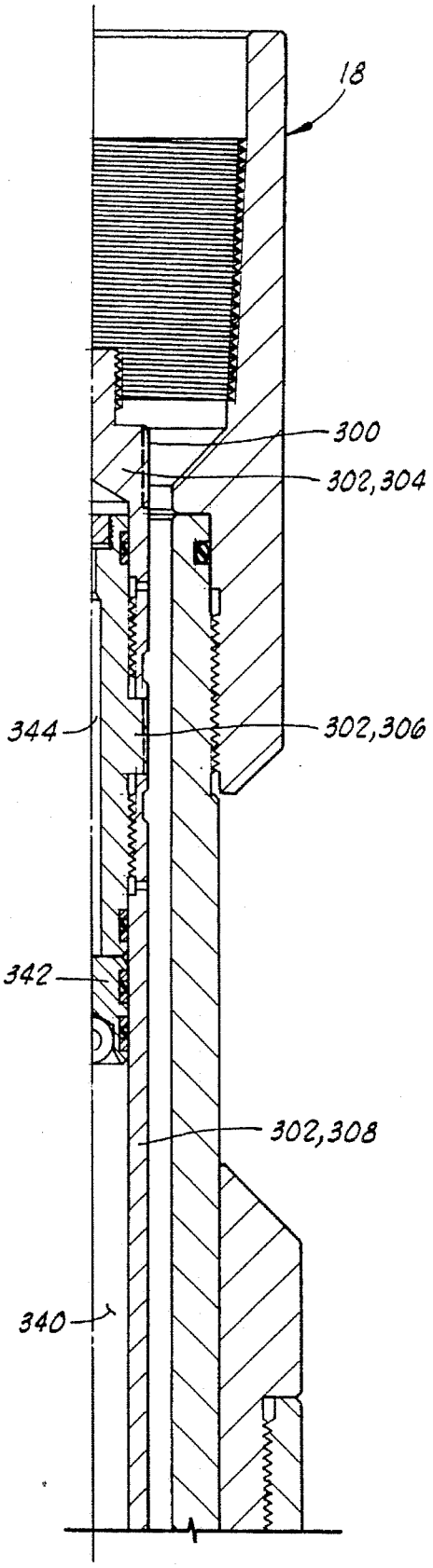
FIGS. 9A–9D illustrate the straddle packer assembly of FIGS. 3A–3D having an injection canister partially received therein.
Figure 9B:
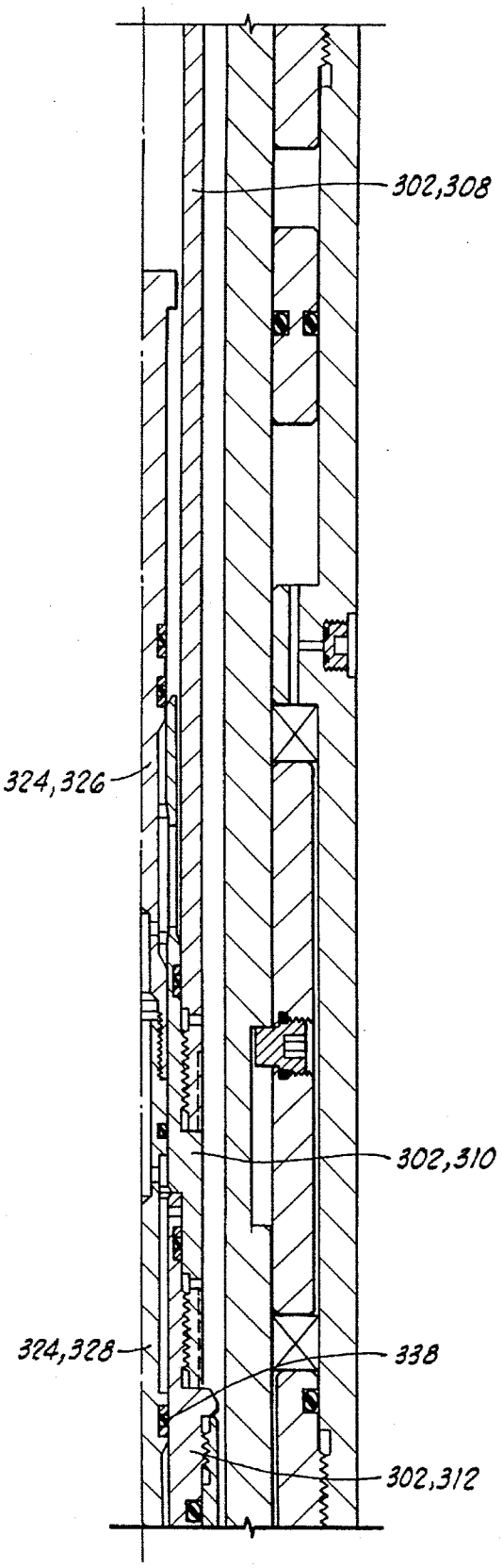
Figure 9C:
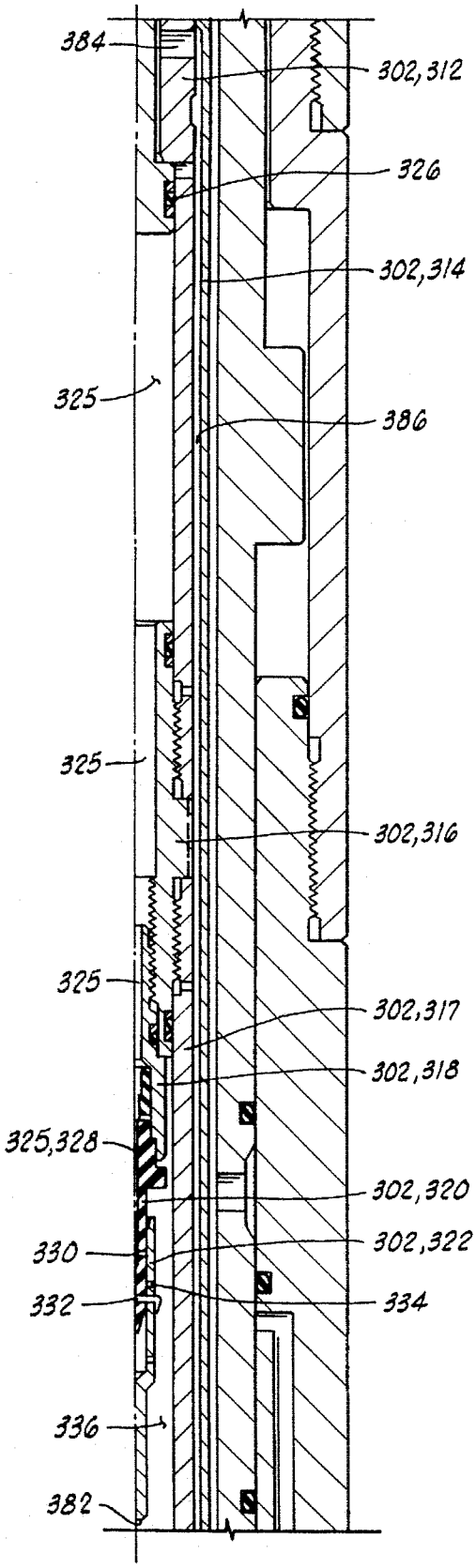
Figure 9D:
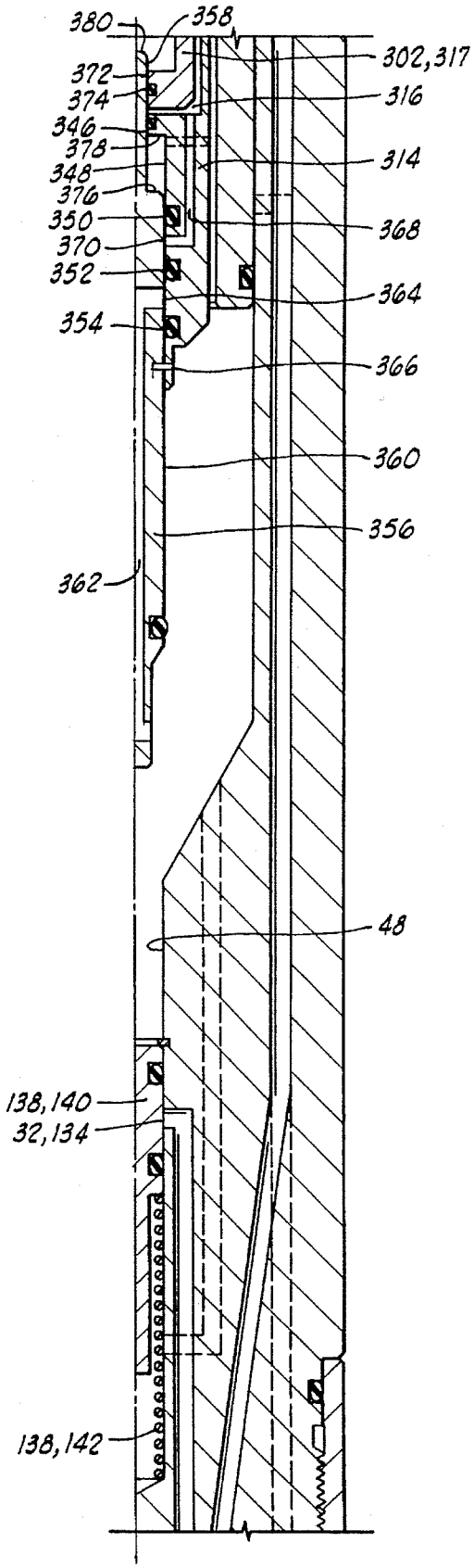
Figure 10A:
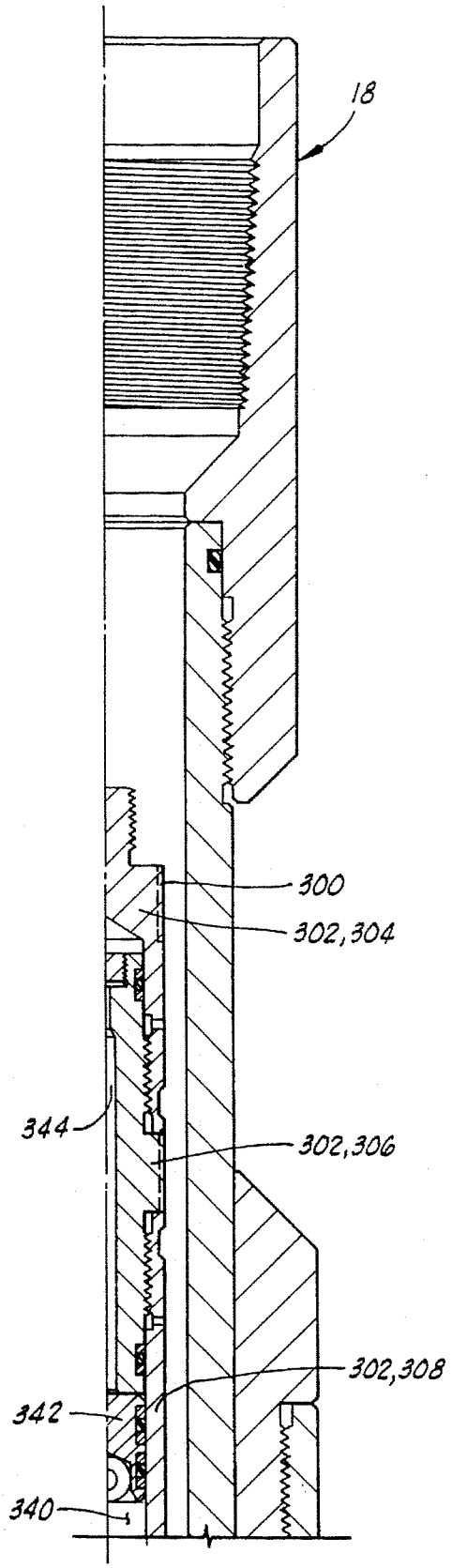
FIGS. 10A–10D comprise an elevation sectioned view of the apparatus of FIGS. 9A–9D with the injection canister fully inserted so that pressurized treatment fluid can be injected into the subsurface formation.
Figure 10B:
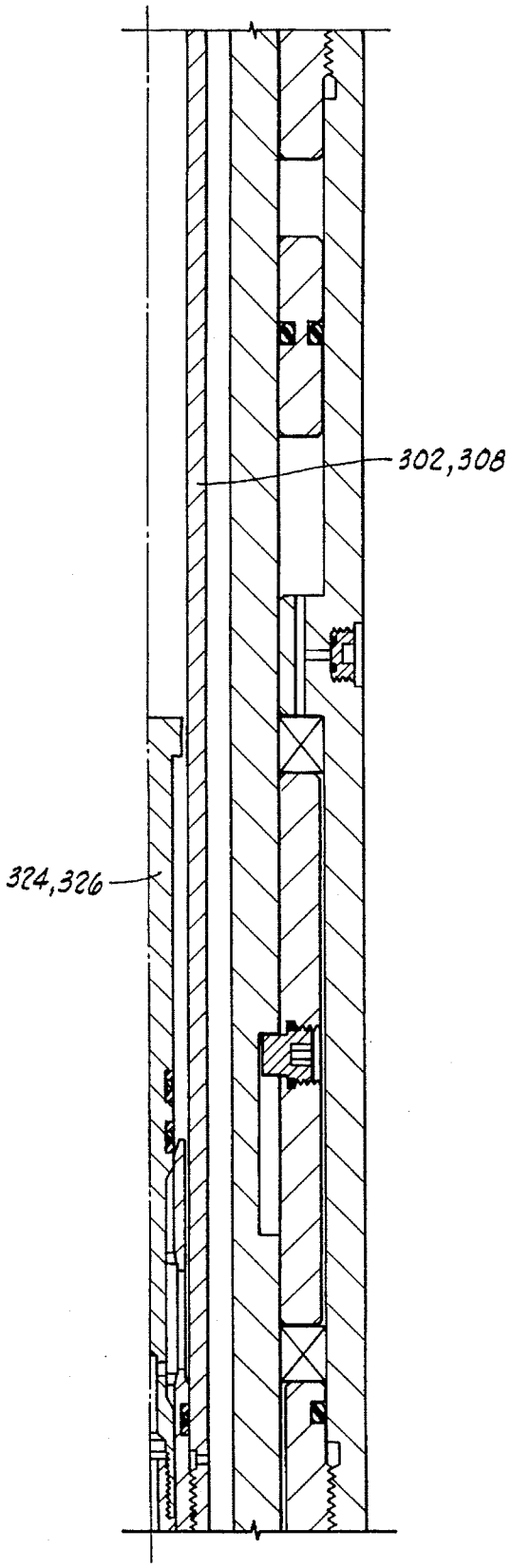
Figure 10C:
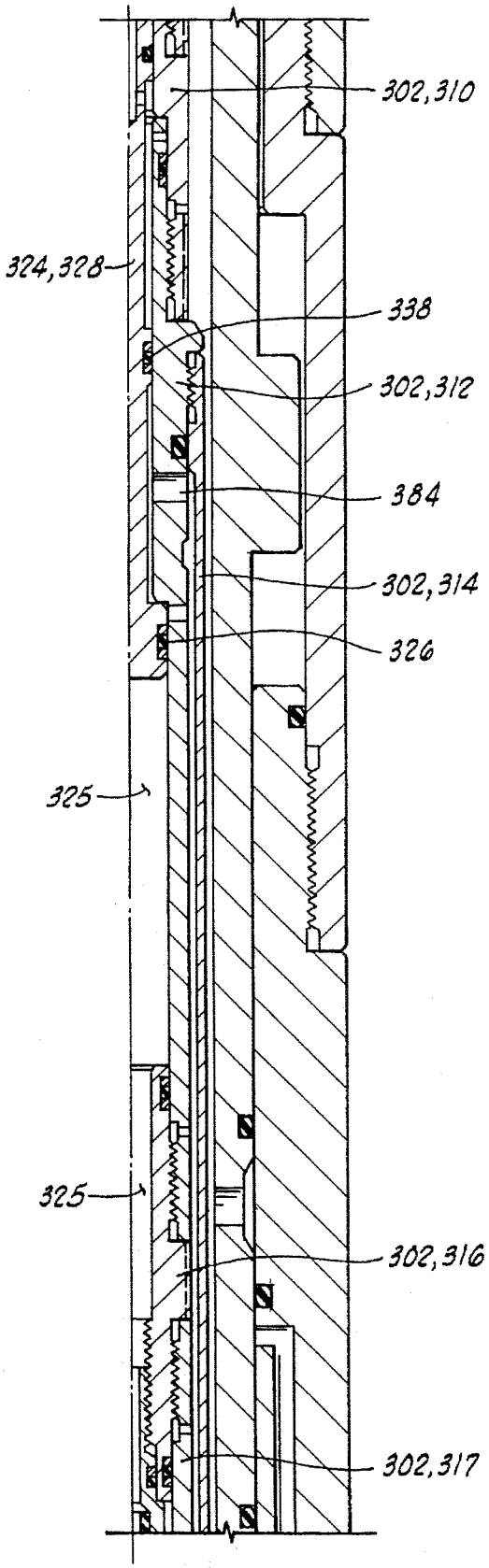
Figure 10D:
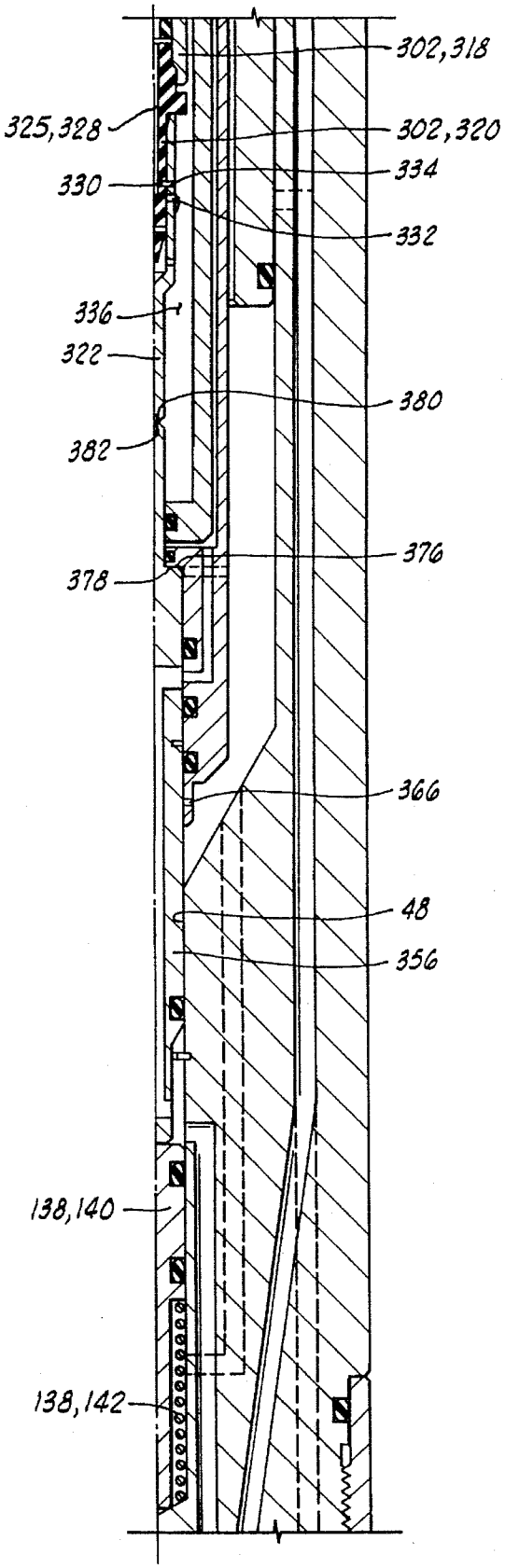

The lower housing shell 314 seen in FIG. 9D has a bore 346 defined therethrough with a counterbore 348 located below bore 346. The counterbore 348 carries first, second and third O-ring seals 350, 352 and 354.

A stinger 356 is slidably received in the lower housing shell 314. Stinger 356 includes an upper portion having a cylindrical outer surface 358 closely received through bore 346, and an intermediate portion having a cylindrical outer surface 360 closely received in counterbore 348.

Stinger 356 includes a stinger passage 362 having a port 364 communicated with cylindrical outer surface 360. Shear pins 366 initially holds stinger 356 in the position shown in FIG. 9D with the port 364 located between O-ring seals 352 and 354. A fluid injection passage 368 is defined in lower housing shell 314 and has a lower port 370 communicated with counterbore 348. In the position of FIG. 9D, the injection passage 368 is closed by stinger 356.

The upper portion of stinger 356 as mentioned extends through bore 346 of lower housing shell 314. It also extends through a bore 372 of dump chamber housing section 317 and engages an O-ring seal 374 therein.

When the injection canister 300 is lowered into engagement with the seal bore 48 as shown in FIGS. 10A–10D, the communication valve member 140 is pushed downward to an open position, then shear pin 366 is sheared allowing stinger 356 to move upward within counterbore 348 until an upward facing shoulder 376 of stinger 356 abuts a downward facing shoulder 378 of lower housing shell 314.

As the uppermost portion of stinger 356 which extends through the bore 372 of dump chamber housing section 317 moves upward, an upper end 380 thereof engages a lower end 382 of orifice valve sleeve 322. The orifice valve sleeve 322 is pushed upward thus shearing shear pin 332 and allowing the sleeve 322 to move upward relative to nosepiece 320 until the ports 334 and 330 are in registry with each other.

Then, the sliding valve assembly 324 can move downward due to the differential pressure acting thereacross and force oil out of oil chamber 325 through the aligned orifices 330 and 334 into the dump chamber 336. Sliding valve assembly 324 will move downward slowly due to this metering effect.

When the O-ring seal 338 of sliding valve assembly 324 moves below a port 384 in the lower valve housing 312, the pressurized acid in acid chamber 340 can escape through port 384 and then flow downward through a thin annular space 386 between outer housing shell 314 on the outside and lower valve housing 312, orifice housing 316, and dump chamber housing section 317 on the inside. The annular space 316 is communicated with the injection passage 368 through which it flows to stinger passage 362 and then to communication passage 32 through which it is communicated with a subsurface formation 14. The metering of oil through orifices 330 and 334 provides a time delay after stabbing into the seal bore and prior to actual release of the acid through port 384.

The pressurized nitrogen contained in nitrogen chamber 344 will expand pushing floating piston 342 downward thus displacing the acid contained in acid chamber 340 through the path just described. Thus the subsurface formation 14 can be treated with acid or other liquid through use of the injection canister 300. Then the injection canister 300 can be retrieved with wireline 34 and subsequently a flow test utilizing the surge tool 42 can be performed as previously described.

Detailed Description Of The Embodiment Of FIGS. 11A–11D

FIGS. 11A–11D comprise an elevation, right-side only sectioned view of a modified version of the wireline conveyed surge tool of FIGS. 3–7 wherein a gauge carrier has been incorporated in the inner tool which is run on the wireline. This self-contained Gauge carrier will be placed in fluid communication with the subsurface formation 14 when the apparatus is engaged with the seal bore 48 and can then monitor various parameters such as pressure of the well fluid in the subsurface formation 14 prior to and during the flowing of the well fluid sample into the sample chamber.

The inner well tool shown in FIGS. 11A–11D is generally referred to by the numeral 400 and can be described as a combined sampler/gauge carrier 400.

In FIGS. 11A–11D the sampler/gauge carrier 400 has been lowered on wireline 44 into engagement with the seal bore 48 and corresponds to the position schematically illustrated in FIG. 1C.

The surge chamber and lower end of the apparatus 400 including the stinger are identical in construction to and are in the identical positions previously illustrated and described with regard to FIGS. 5A–5D. Like identifying numerals have been utilized for the like components.

The difference lies in the construction of the part which in FIGS. 5A–5D was referred to as the lower surge tool housing shell 194 which terminated at a threaded connection 195 where it is attached to the lower valve housing 192.

Figure 5A:
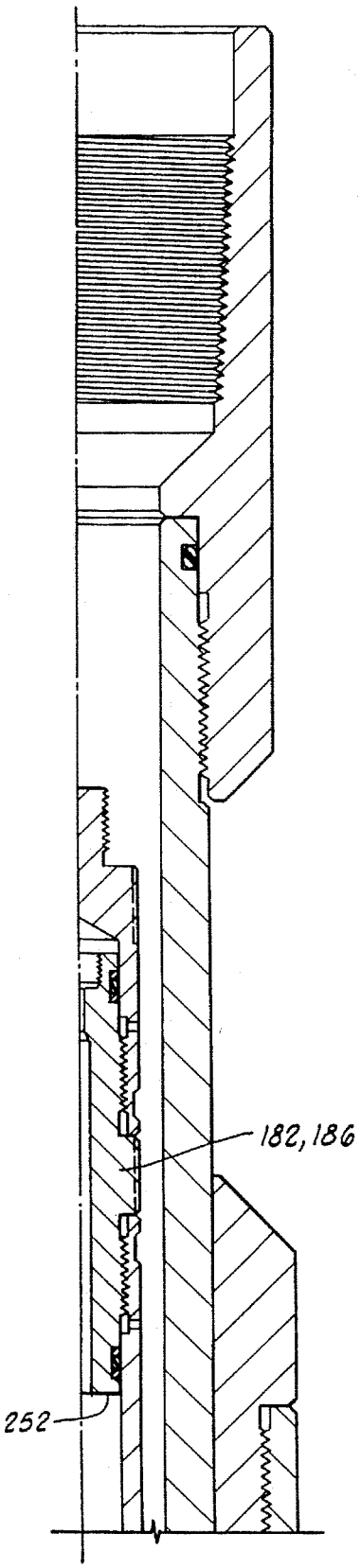
FIGS. 5A–5E comprise a sectioned elevation view of the upper portion of the assembly of FIGS. 3A–3E with the surge chamber engaged in a position so that a well fluid sample is flowing from between the packers into the surge chamber. This corresponds to the position schematically illustrated in FIG. 1C.
Figure 5B:
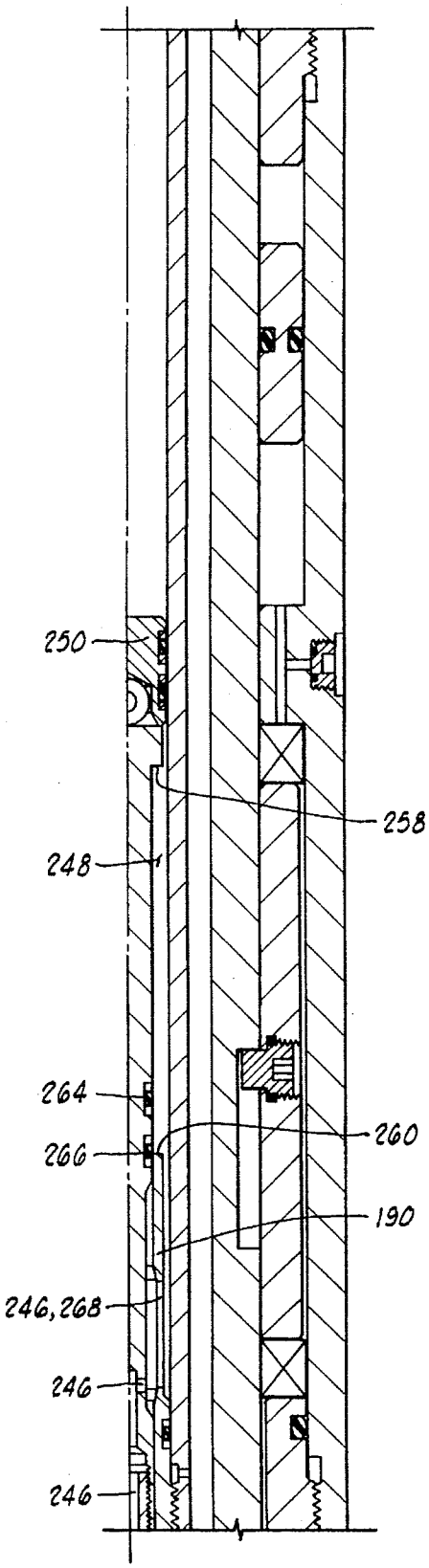
Figure 5C:
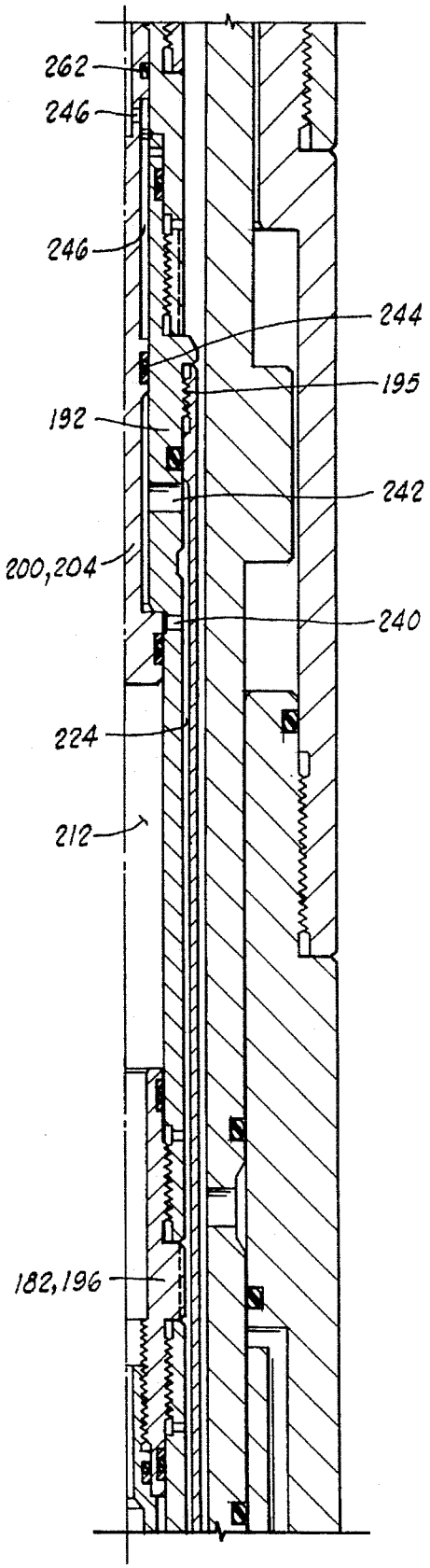
Figure 5D:
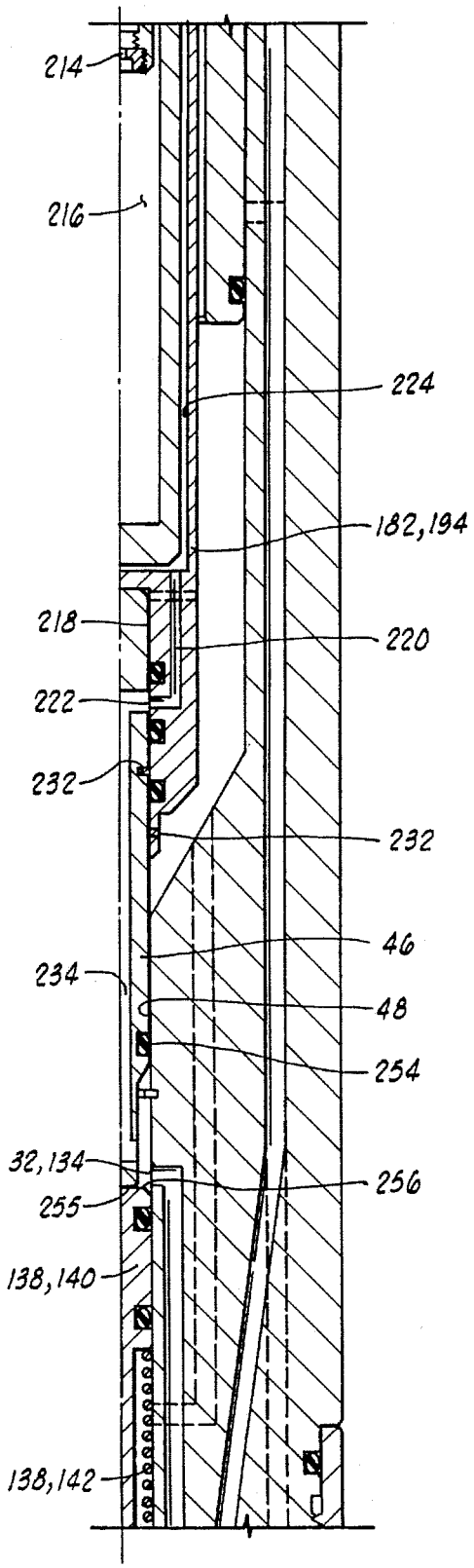
Figure 5E:
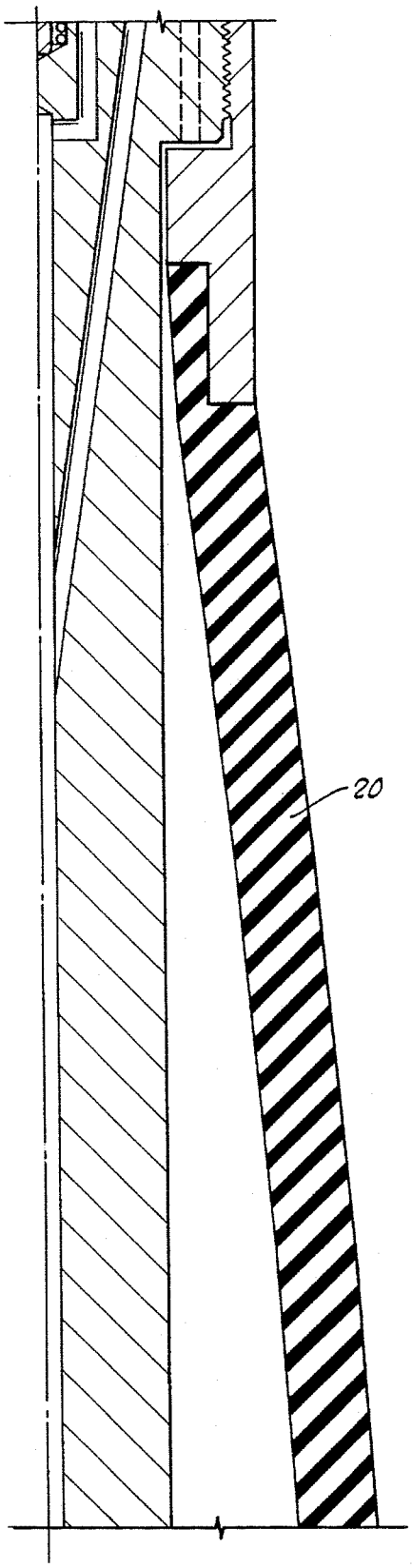
Figure 6A:
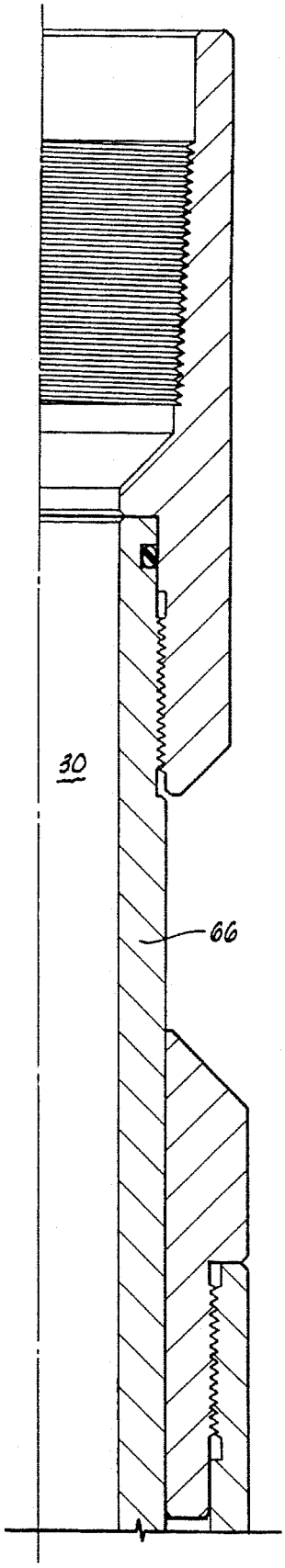
FIGS. 6A–6E comprise an elevation sectioned view of the upper portions of the assembly of FIGS. 3A–3E after the surge chamber has been removed and with the assembly in an equalizing position wherein pressure in the wellbore between the straddle packer elements is equalized with pressure inside the outer tubing string.
Figure 6B:
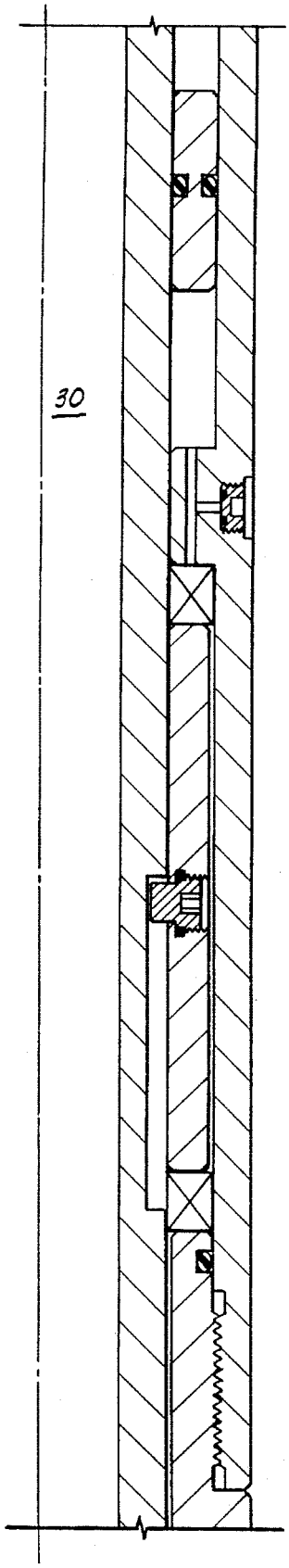
Figure 6C:
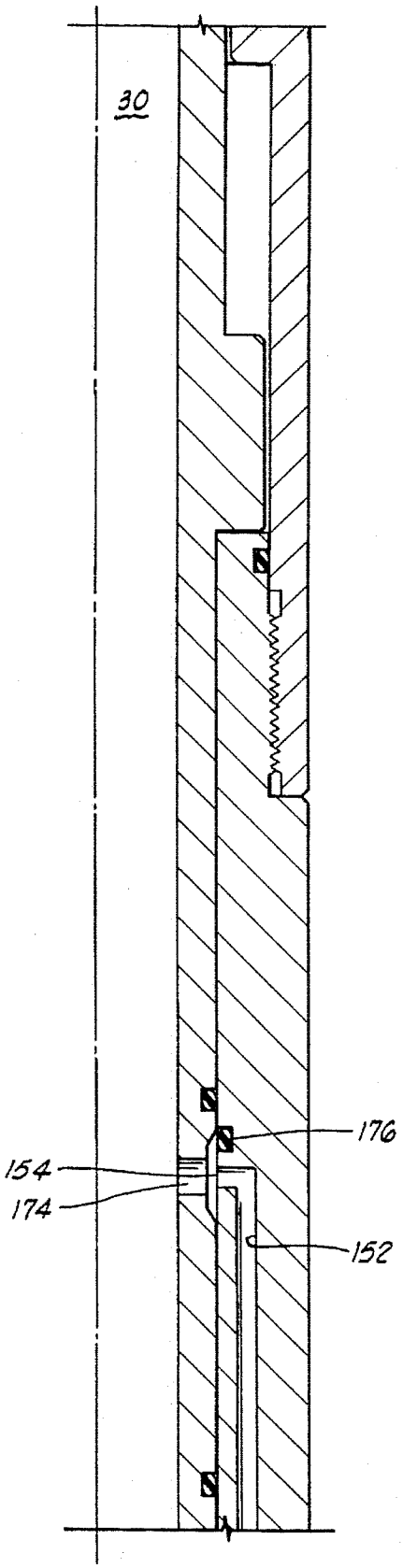
Figure 6D:
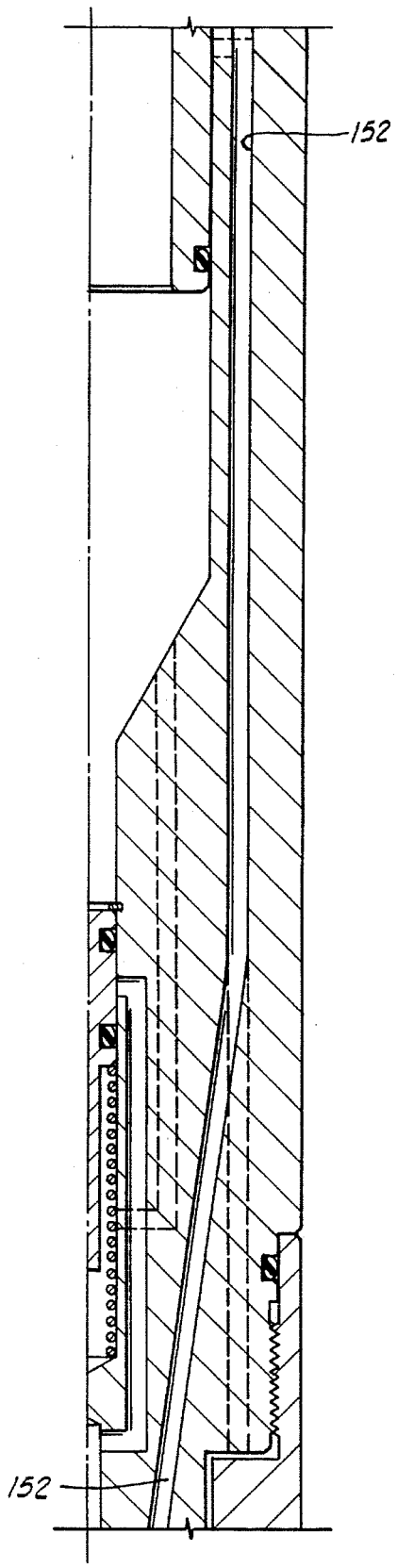
Figure 6E:
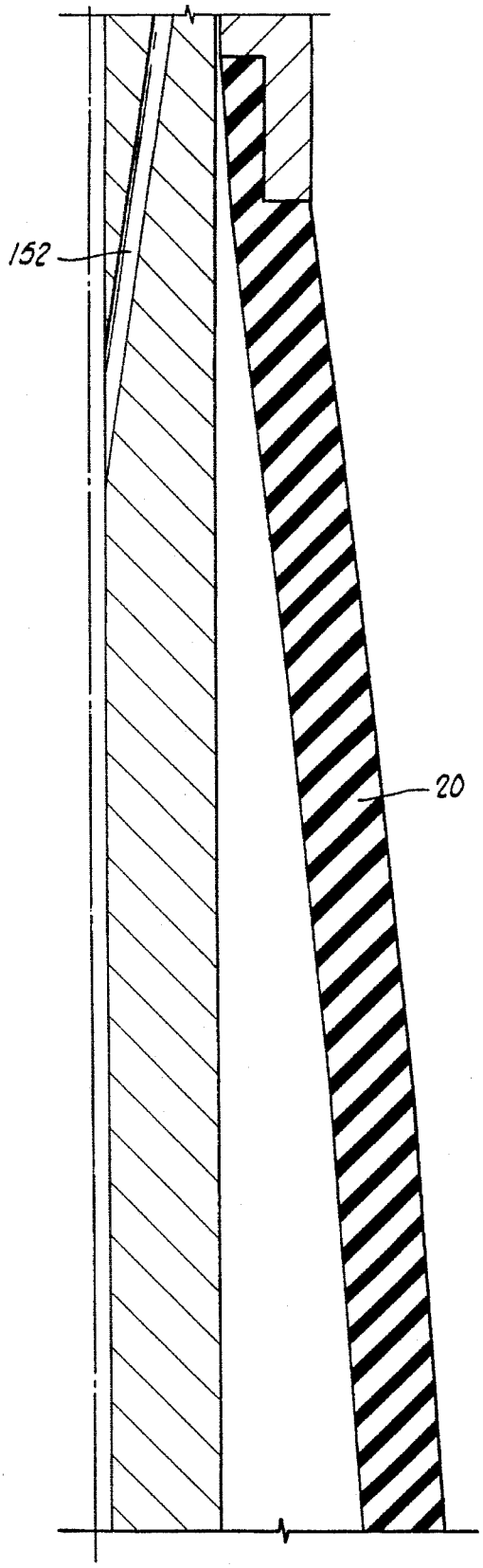
Figure 11A:
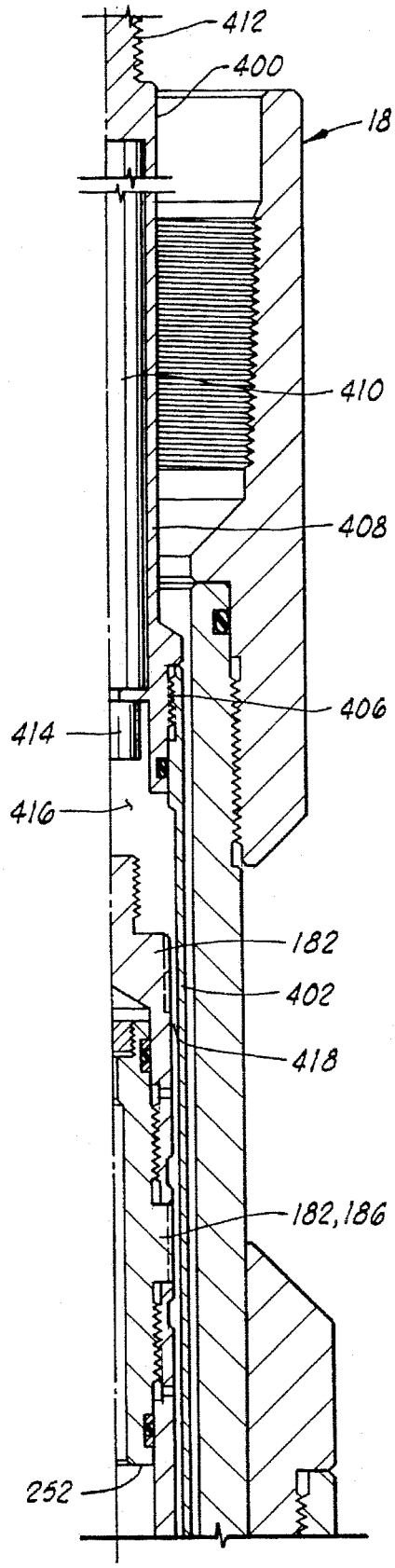
FIGS. 11A–11D comprise an elevation sectioned view of yet another embodiment of the invention illustrating the use of a surge chamber similar to that shown in FIGS. 3A–3J which also carries a pressure gauge which monitors the pressure of the well fluid.
Figure 11B:
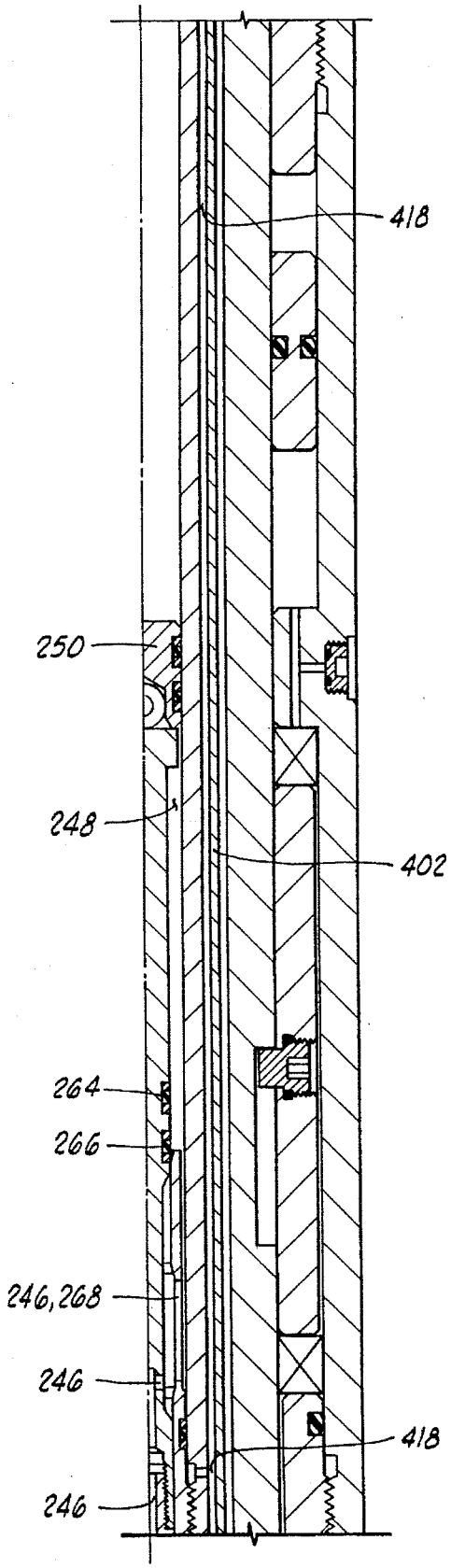
Figure 11C:
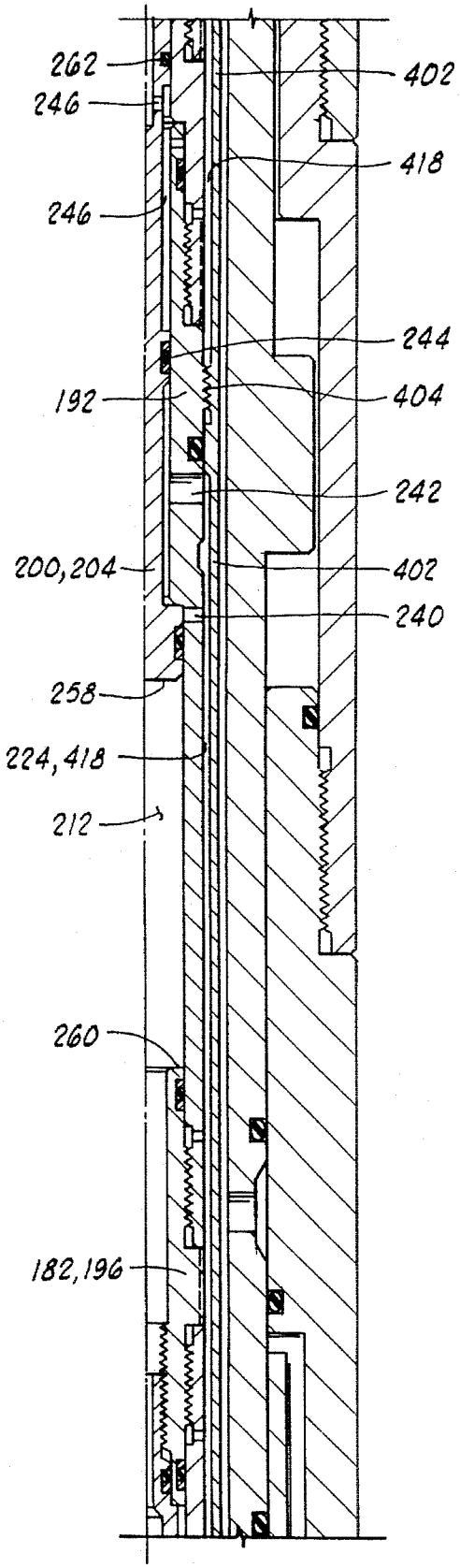

In the embodiment of FIGS. 11A–11D, the surge tool housing shell is denoted by the numeral 402 and is still connected to the lower valve housing 192 at a thread 404 analogous in position to the thread 195 of FIG. 5C. In the embodiment of FIGS. 11A–11D, however, the housing shell 402 extends upward beyond thread 404 and beyond the upper end of the sample chamber as seen in FIG. 11A where it attaches at thread 406 to a gauge carrier housing 408. A downhole memory gauge 410 is contained within gauge housing 408. The details of construction of the electronic components of downhole memory gauge 410 may be similar to those described in Anderson et al. U.S. Pat. No. 4,866,607.

A threaded wireline connection 412 is provided at the upper end of gauge carrier housing 408 for connection to the wireline 44.

A pressure transducer 414 is associated with the downhole memory gauge 410 and is exposed to a fluid chamber 416 which in turn is communicated with the subsurface formation 14 in the following manner.

A thin annular space 418 is defined between the surge tool housing shell 402 on the outside and the outer surface of the surge tool housing assembly 182 on the inside. The annular space 418 includes the space below thread 404 which in the embodiment of FIGS. 4A–4D was referred to as the annular space 224. The annular space 418 above and below the threads 404 is communicated together by a groove (not shown) in the threads 404.

At its lower end, the thin annular space 418 communicates with the surge passage 220 which in turn communicates with stinger passage 234 and then with the communication passage 32 which leads to subsurface formation 14.

Figure 11D:
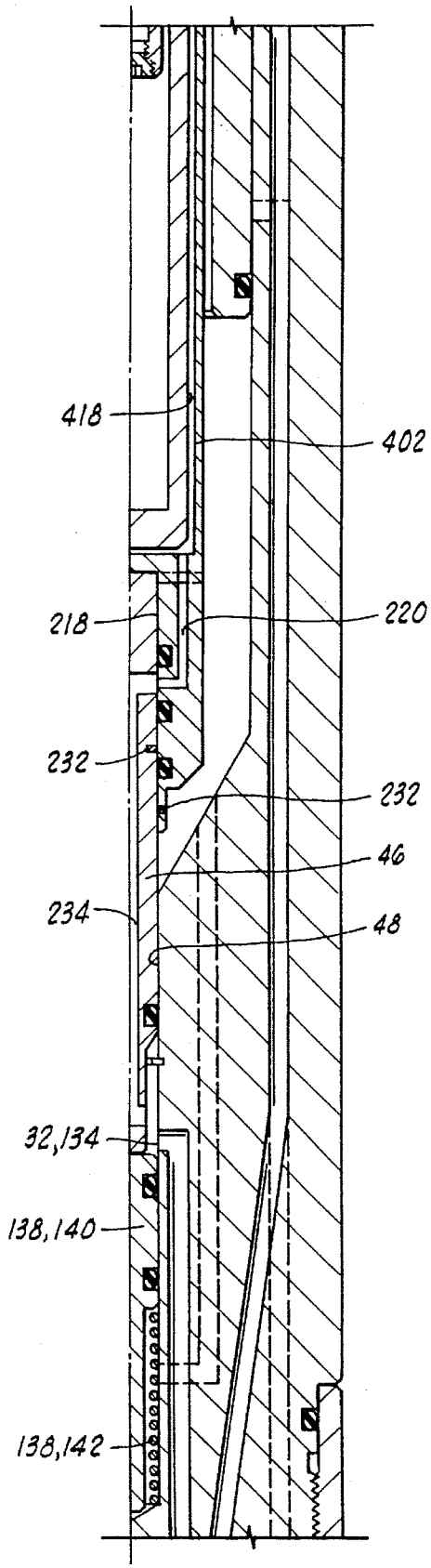

Thus with the embodiment of FIGS. 11A–11D, as soon as the stinger 46 is engaged with the seal bore 48 to open the communication valve 138, and to move the stinger 46 to the position shown in FIG. 11D wherein stinger passage 234 is communicated with surge passage 220, the pressure transducer 414 will be in fluid communication with the subsurface formation 14 and thereafter can monitor pressure and other parameters until such time as the apparatus 400 is withdrawn from engagement with seal bore 48 by means of wireline 44.

Data taken during and after surging of the formation 14 may provide usable drawdown and buildup test data.

Figure 13:
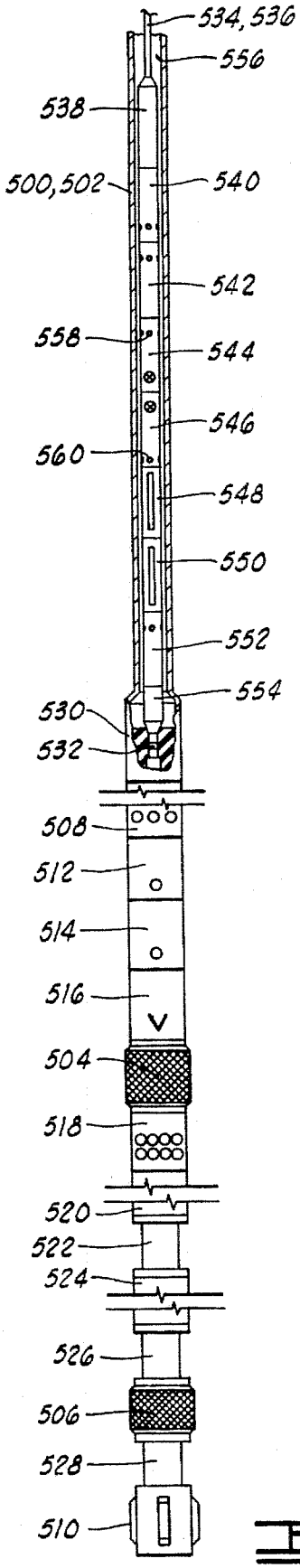
FIG. 13 is a schematic elevation partially sectioned view of another embodiment of the invention utilizing an annulus pressure responsive coiled tubing drill stem test string located within an outer tubing string which carries inflatable packers and a downhole pump.
Figure 14:
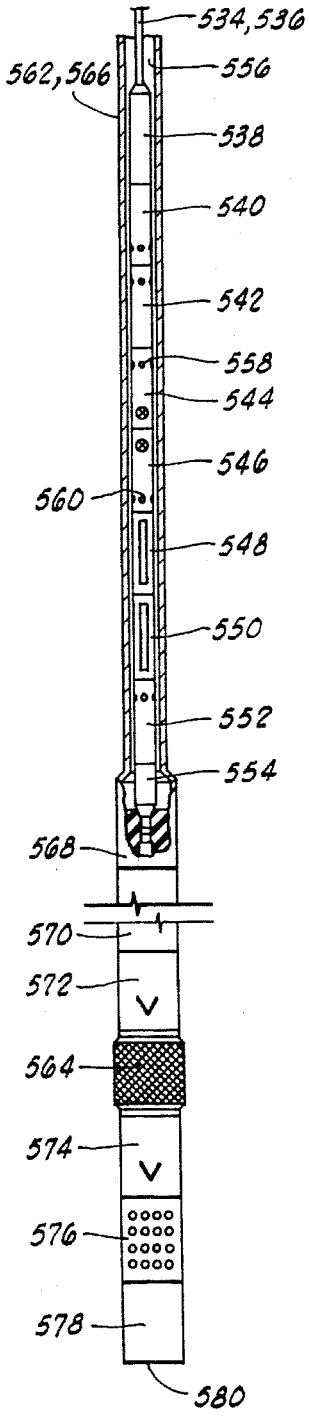
FIG. 14 is a schematic elevation, partially sectioned view of yet another embodiment of the invention which is similar to that of FIG. 13 but which utilizes a compression set packer rather than inflatable packers on the outer tubing string.

The Embodiments Of FIGS. 13 And 14 Utilizing Concentric String Annulus Pressure Responsive Testing In An Uncased Borehole FIGS. 13 and 14 are schematic elevation illustrations of two alternative versions of the scenario generally schematically illustrated in FIGS. 2A–2C. In each of these versions an outer tubing string is set in an open uncased borehole, and a concentric inner tubing string, preferably run on coiled tubing, is run into the outer tubing string and engaged therewith. Subsequently well fluid can flow up through the innermost tubing string to the surface. The two tubing strings define a tubing annulus therebetween which can be utilized to operate annulus pressure responsive type testing tools.

In the embodiments of FIGS. 13 and 14, the outer tubing strings have been greatly modified as compared to the outer tubing string 16 described with regard to the prior embodiments.

In the embodiment of FIG. 13, the outer tubing string is generally designated by the numeral 500. Its upper portion is made up of a string of drill pipe or other outer tubing 502. It carries an inflatable straddle packer including top and bottom packer elements 504 and 506 which are inflated by a downhole pump 508. The downhole pump 508 is operated by rotation of the tubing string 502. Those tools located below pump 508 are prevented from rotating due to the presence of belly springs 510 which frictionally engage the open uncased borehole 12.

A pressure limiter 512 is associated with the downhole pump 508. A bypass/deflate tool 514 and a safety joint 516 are located between the pressure limiter 512 and the top inflatable packer element 504.

Located between the top and bottom packer elements 504 and 506 are a port assembly 518, a blank anchor 520, a crossover 522, one or more drill collars 524, and a crossover 526. The bottom packer element 506 is connected to the belly springs 510 by a spacing/crossover 528.

The rotationally operated downhole pump 508 and inflatable packers 504 and 506 and various related structure just identified preferably are provided in the form of a Hydroflate system available from Halliburton Company, the assignee of the present invention. The Hydroflate system is generally shown and described in U.S. Pat. No. 4,246,964 to Brandell, and U.S. Pat. No. 4,313,495 to Brandell, both assigned to the assignee of the present invention and incorporated herein by reference.

A polished bore receptacle 530 is located above the downhole pump 508 and has a polished bore or seal bore 532 defined therein which is analogous to the seal bore 48 previously described.

The outer tubing string 500 is used in a manner analogous to the outer tubing string 16 previously described and can be lowered into place as shown in FIG. 1A and then the packers thereof set within the open uncased borehole 12 by operation of the rotational downhole pump 508 to inflate the same.

Then, an inner tubing string, which may generally be described as an inner well tool 534 is lowered into the outer tubing string 500. The inner tubing string 534 includes as its uppermost portion a string of relatively small diameter tubing 536. The small diameter tubing 536 preferably is a continuous string of coiled tubing, but may also be provided by small diameter tubing segments which are connected together. The small diameter tubing 536 carries on the lower end thereof a string of slim hole testing tools including from top to bottom the following components. Immediately below the small diameter tubing 36 are one or more weight bars 538. Below the weight bars 538 there is located a weight operated circulating valve 540, a rupture disc circulating valve 542, a recloseable annulus pressure responsive circulating valve 544, a recloseable annulus pressure responsive ball type tester valve 546, a sampling tool 548 for trapping a well fluid sample, an electronic gauge carrier 550 for carrying pressure and temperature monitoring and recording apparatus, a rupture disc circulating valve 552, and an inner tubing stinger assembly 554. Stinger assembly 554 stings into the seal bore 532 to place the interior of inner tubing string 536 in communication with the subsurface formation 14 through the port assembly 518 located between upper and lower packer elements 504 and 506.

A tubing annulus 556 is defined between the drill pipe 502 on the outside and the inner tubing string 536 and associated tools on the inside. The annulus pressure responsive recloseable circulating valve and recloseable tester valve 544 and 546 each have power ports such as 558 and 560, respectively, communicated with the tubing annulus 556 so that the valves 544 and 546 may be operated in response to changes in pressure within the tubing annulus 556.

Thus with the tool string shown in FIG. 13, the outer tubing string 500 can be set in the open uncased borehole 12, and then the inner tubing string 534 can be run into engagement therewith to conduct all of the tests conducted with conventional drill stem testing. This is accomplished without encountering the dangers of differential sticking in the uncased borehole, because all of the flow control valves are located in the inner tubing string 534 which operates within the confines of the outer tubing string 500 and thus is not subject to differential sticking.

With the system shown in FIG. 13, multiple drawdown/buildup tests can be run on the formation 14 and all conventional drill stem testing and treatment type procedures may also be conducted.

FIG. 14 uses the same inner tubing string 534 just described, but has a modified outer tubing string designated by the numeral 562 which utilizes a compression set open hole packer 564 rather than inflatable packers.

The upper portion of outer tubing string 562 is made up of a string of drill pipe or other tubing 566. The other components of the outer tubing string include polished bore receptacle 568, one or more drill collars 570, safety joint 572, anchor pipe safety joint 574, perforated anchor 576, and anchor pipe 578.

To set the open hole packer 564 in the open uncased borehole 12, a lower end 580 of anchor pipe 578 is engaged with the bottom end of the uncased borehole 12 so that the weight of the outer tubing string 562 may be placed in compression across the open hole packer 564. That compression along with a rotational motion of the outer tubing string 562 will actuate the open hole packer and the compression forces will cause the packing element thereof to be squeezed outwardly into a sealing engagement with the open uncased borehole 12 above the subsurface formation 14 which is to be tested.

It will be understood that with the compression set packer of FIG. 14, the test must be run before the borehole 12 is extended a great distance beyond the formation 14 which is to be tested. Through choice of the lengths of the components 574, 576 and 578, some variation can be provided in the height of the open hole packer element 564 above the bottom of the uncased borehole. Typically, open hole packers such as packer 564 can be placed up to thirty feet above the bottom of the borehole.

Once the outer tubing string 562 is set within the open uncased borehole 12, the inner tubing string 534 is run into place therein and operated in the manner as described above with regard to FIG. 13.

When running a coiled tubing string it may be necessary to take positive action to prevent collapse of the coiled tubing string due to the hydrostatic pressure present in the borehole. If this is a concern, the coiled tubing string can be run with pressurized nitrogen gas inside the tubing string to offset the exterior hydrostatic pressure.

With the coiled tubing inner string as shown in FIGS. 13 and 14 having the various annulus pressure responsive tools located therein, one or more of the circulating valves would be opened as the string is run into the well so that the coiled tubing string would fill with mud. Then prior to flowing well fluid up from the subsurface formation 14, a cushion of lighter fluid such as diesel oil is spotted in the coiled tubing string immediately above the flow tester valve 546. Alternatively, the circulating valve can be closed when the coiled tubing string has been partly run into the well so that the coiled tubing string is run to its final position only partially filled with well fluid thus providing an underbalance when the tester valve is opened to communicate the coiled tubing string with the subsurface formation.

Methods Of Operation

The methods of using all of the tool strings described above can generally be referred to as methods of servicing the well 10 having the uncased borehole 12 intersecting the subsurface formation 14. As previously noted, the term servicing as used herein is used in a broad sense to include both testing of wells where fluids are flowed from the well for sampling and to include treatment of wells where fluids are flowed into the well such as for acid treatment or the like.

All of those embodiments illustrated in FIGS. 1–11 can generally be described as being operated in accordance with the following method:

(a) The outer tubing string 16 is run into the well 10. The outer tubing string 16 includes a packer having at least one inflatable element like the elements 20 or 22. The communication passage 32 communicates the interior 30 of the outer tubing string 16 with the borehole 12 below the packer element 20. The inflation passage 156 communicates the inflatable element 20 with the interior 30 of the outer tubing string 16. An inflation valve defined by port 158 and sliding mandrel 66 with seals 168 and 170 defines an inflation valve having an open position as illustrated in FIG. 3D wherein the inflation passage 156 is open and having a closed position as illustrated in FIG. 4D where the inflation passage 156 is closed. The inflation valve is movable between its open and closed positions by surface manipulation of the outer tubing string 16 as controlled by the J-slot and lug assembly 76, 78.

(b) With the inflation valve in its open position as seen in FIG. 3D, the inflatable element 20 is inflated by increasing fluid pressure in the interior 30 of the outer tubing string 16 thereby setting the packer in the borehole 12 with at least one element such as element 20 thereof being set above the subsurface formation 14 which is to be tested.

(c) After step (b), the inflation valve is closed by surface manipulation of the outer tubing string 16 to maintain the packer 20 set in the borehole 12.

(d) After closing the inflation valve, an inner well tool such as surge tool 42 or coiled tubing string 50 is run into the outer tubing string 16.

(e) The stinger 46 of the inner well tool 42 is then engaged with the seal bore 48 of the outer tubing string 16 thus placing the inner well tool in fluid communication with the subsurface formation through the communication passage 32.

(f) Then, a fluid sample is flowed from the subsurface formation 14 through the communication passage 32 into the sample chamber of inner well tool 42 or up through the coiled tubing string 50 to the surface.

It will be appreciated that numerous well fluid samples can be taken while the outer tubing string 16 remains in place. Subsequently, the packers can be deflated and the outer tubing string can be moved to a second location and additional well fluid samples can be taken. All of this can be conducted in an open, uncased borehole. The dangers of flowing well fluid up through a tubing string which is subject to differential sticking in the open uncased borehole are eliminated. Far superior samples and data are provided as compared to side wall pad type testers.

Also, the formation 14 may be surged a first time to clean drilling mud and the like from the annulus 39 between packers 20 and 22. Then a second surge chamber 42 may be run to take a clean formation fluid sample.

As best illustrated in FIGS. 13 and 14, such a coiled tubing string can include an annulus pressure responsive flow tester valve 546 which can be repeatedly opened and closed to perform multiple drawdown and buildup tests upon the subsurface formation 14. Annulus pressure responsive valves like illustrated in FIGS. 13 and 14 may also be utilized in the coiled tubing inner string shown in FIGS. 7 and 8.

Alternatively the surge tool 42 may be designed to be pumped down into the outer tubing string and pumped back up or U-tubed back up thus eliminating the wireline 44. Similarly, using the concentric tubing strings as shown in FIGS. 2A-2C, sample chambers could be pumped down into the inner tubing string and then pumped back up using the tubing annulus to reverse circulate.

In the embodiment illustrated in FIGS. 9 and 10, the inner well tool may comprise the fluid injection tool 300 which will inject a treatment fluid such as acid through the communication passage 32 into the subsurface formation 14.

As previously noted, there is a communication valve 138 associated with the communication passage 32. As any of the inner well tools are engaged with the seal bore 48 of the outer tubing string 16, they move the communication valve 138 to its open position. Prior to engagement of the inner well tool with the seal bore 48, the communication valve 138 is maintained in a closed position by action of the spring 142.

Preferably, the outer tubing string 16 schematically illustrated in FIGS. 1 and 2 includes the circulating valve 38. This circulating valve 38 is located above the packer 20 and communicates the interior 30 of outer tubing string 16 with the well annulus 39 between the borehole 12 and the outer tubing string 16. When the inner well tool 42 is in engagement with the outer tubing string 16 as illustrated schematically in FIG. 1C, preferably the circulating valve 38 will be in an open position and well fluid will be circulated through the annulus 39 to aid in preventing the sticking of the outer tubing string 16 in the uncased borehole 12 due to differential pressures acting thereon.

Thus it is seen that the apparatus and methods of the present invention readily achieve the ends and advantages mentioned as well as those inherent therein. While certain preferred embodiments have been illustrated and described for the purposes of the present disclosure, numerous changes may be made by those skilled in the art which changes are encompassed within the scope and spirit of the present invention as defined by the appended claims.

What is claimed is:

1. A method of servicing a well having an uncased borehole intersecting a subsurface zone or formation of interest, comprising:

(a) running an outer tubing string into said well, said outer tubing string including:

a packer having an inflatable element;

a communication passage communicating an interior of said outer tubing string with said borehole below said packer;

an inflation passage communicating said inflatable element with said interior of said outer tubing string; and an inflation valve having an open position wherein said inflation passage is open, and having a closed position wherein said inflation passage is closed, said inflation valve being movable between its said open and closed positions by surface manipulation of said outer tubing string;

(b) with said inflation valve in its said open position, inflating said inflatable element by increasing fluid pressure in said interior of said outer tubing string, and thereby setting said packer in said borehole above said subsurface zone or formation;

(c) after step (b), closing said inflation valve by surface manipulation of said outer tubing string to maintain said packer set in said borehole;

(d) after step (c), running an inner well tool into said outer tubing string; and (e) engaging said inner well tool with said outer tubing string and placing said inner well tool in fluid communication with said subsurface zone or formation through said communication passage.

2. The method of claim 1, wherein:

in step (a) said packer is a retrievable inflatable straddle packer having upper and lower packer elements; and in step (b) said upper and lower packer elements are set above and below said subsurface zone or formation, respectively.

3. The method of claim 1, further comprising:

(f) after step (e), flowing a fluid sample from said subsurface zone or formation through said communication passage to said inner well tool.

4. The method of claim 3, wherein:

in step (d) said inner well tool includes a surge chamber; and said method further includes:

(g) trapping said fluid sample in said surge chamber; and (h) retrieving said surge chamber and said fluid sample to a surface location without unsetting said packer.

5. The method of claim 4, further comprising:

repeating steps (d) through (h) as necessary to trap and retrieve additional well fluid samples without unsetting said packer.

6. The method of claim 3, wherein:

step (d) includes running said inner well tool on a coiled tubing string into said outer tubing string; and step (f) includes flowing said fluid sample up through said coiled tubing string to a surface location to flow test said subsurface zone or formation.

7. The method of claim 6, wherein:

in step (d) said inner well tool includes a coiled tubing closure valve which is maintained in a closed position during step (d); and step (e) includes moving said coiled tubing closure valve to an open position thereof substantially simultaneously with engaging said inner well tool with said outer tubing string and thereby placing an interior of said coiled tubing string in communication with said subsurface zone or formation through said communication passage.

8. The method of claim 6, wherein:

in step (d) said coiled tubing string includes a flow tester valve; and step (f) includes opening said flow tester valve to allow said fluid sample to flow up through said coiled tubing string.

9. The method of claim 8, further comprising:

repeatedly opening and closing said flow tester valve to perform multiple drawdown and buildup tests on said subsurface formation.

10. The method of claim 8, wherein:

in step (d) said tester valve is an annulus pressure responsive tester valve having a power port in fluid communication with a tubing annulus defined between said outer tubing string and said coiled tubing string; and step (f) includes varying a fluid pressure in said tubing annulus to open said flow tester valve.

11. The method of claim 1, wherein:

in step (d) said inner well tool is a fluid injection tool; and said method further includes:

after step (e), injecting a treatment fluid from said fluid injection tool through said communication passage into said subsurface zone or formation.

12. The method of claim 1, wherein:

in step (a) said outer tubing string further includes a communication valve associated with said communication passage, said communication valve having open and closed positions wherein said communication passage is open and closed, respectively.

13. The method of claim 12, wherein:

step (e) includes moving said communication valve to its said open position with said inner well tool.

14. The method of claim 1, wherein:

in step (a) said outer tubing string has a seal bore defined therein and communicated with said communication passage; and in step (d) said inner well tool includes a stinger; and step (e) includes inserting said stinger of said inner well tool into said seal bore of said outer tubing string.

15. The method of claim 1, wherein:

in step (a) said outer tubing string includes a circulating valve located above said packer and communicating said interior of said outer tubing string with a well annulus between said borehole and said outer tubing string above said packer; and said method further includes:

while said inner well tool is in fluid communication with said subsurface formation through said communication passage, circulating fluid through said well annulus and through said circulating valve and thereby preventing sticking of said outer tubing string in said uncased borehole.

16. A method of servicing a well having an uncased borehole intersecting a subsurface zone, comprising:

(a) running an outer tubing string into a well, said outer tubing string including:

a retrievable straddle packer having upper and lower packer elements;

a circulating valve located above said upper packer element and communicating an interior of said outer tubing string with a well annulus between said borehole and said outer tubing string; and a communication passage communicating said interior of said outer tubing string with said borehole between said upper and lower packer elements;

(b) setting said upper and lower packer elements in said uncased borehole above and below said subsurface zone, respectively;

c) running an inner well tool into said outer tubing string;

(d) engaging said inner well tool with said outer tubing string and placing said inner well tool in fluid communication with said subsurface zone through said communication passage; and (e) while said inner well tool is in fluid communication with said subsurface zone through said communication passage, circulating fluid through said well annulus and through said circulating valve and thereby preventing sticking of said outer tubing string in said uncased borehole.

17. The method of claim 16, wherein:

step (c) is performed after step (b).

18. The method of claim 16, further comprising:

(f) after step (d), flowing a fluid sample from said subsurface zone through said communication passage to said inner well tool.

19. The method of claim 18, wherein:

in step (c) said inner well tool includes a sample chamber; and said method further includes:

(g) trapping said well fluid sample in said sample chamber; and (h) retrieving said sample chamber and said well fluid sample from said well.

20. The method of claim 19, further comprising:

repeating steps (d), (f), (g) and (h) to trap and retrieve an additional well fluid sample.

21. The method of claim 18, wherein:

step (c) includes running said inner tool on a coiled tubing string into said outer tubing string; and step (f) includes flowing said well fluid sample up through said coiled tubing string to flow test said subsurface zone.

22. The method of claim 21, wherein:

in step (c) said coiled tubing string includes a flow tester valve; and step (f) includes opening said flow tester valve to allow said well fluid sample to flow up through said coiled tubing string.

23. The method of claim 22, further comprising:

repeatedly opening and closing said flow tester valve to perform multiple drawdown and buildup tests on said subsurface zone.

24. The method of claim 22, wherein:

in step (c) said flow tester valve is an annulus pressure responsive flow tester valve having a power port in fluid communication with a tubing annulus defined between said outer tubing string and said coiled tubing string; and step (f) includes varying a fluid pressure in said tubing annulus to open said flow tester valve.

25. The method of claim 16, wherein:

in step (c) said inner well tool is a fluid injection tool; and said method further includes:

after step (d), injecting a treatment fluid from said fluid injection tool through said communication passage into said subsurface zone.

26. The method of claim 16, wherein:

in step (a) said outer tubing string further includes a communication valve associated with said communication passage, said communication valve having open and closed positions wherein said communication passage is open and closed, respectively; and step (d) includes moving said communication valve to its said open position with said inner well tool.

27. The method of claim 16, wherein:

in step (a) said outer tubing string has a seal bore defined therein and communicated with said communication passage; and in step (c) said inner well tool includes a stinger; and step (d) includes inserting said stinger of said inner well tool into said seal bore of said outer tubing string.

28. The method of claim 16, wherein:

in step (a), said upper and lower packer elements are inflatable packer elements;

during step (b) said communication passage is closed; and step (b) includes steps of:

(b)(1) providing an open inflation passage communicating said interior of said outer tubing string with said inflatable packer elements;

(b)(2) increasing fluid pressure in said interior of said outer tubing string and thereby inflating said packer elements; and (b)(3) closing said inflation passage to maintain said inflated packer elements in an inflated state.

29. The method of claim 28, wherein:

steps (b) (1) and (b) (3) are accomplished by manipulation of said outer tubing string.

30. A method of testing a well having an uncased borehole intersecting a subsurface formation, comprising:

(a) running an outer tubing string into said uncased borehole of said well, said outer tubing string including a packer adapted for sealingly engaging said uncased borehole and including a communication passage communicating an interior of said outer tubing string with said borehole below said packer;

(b) setting said packer in said uncased borehole above said subsurface formation;

(c) running an inner tubing string into said outer tubing string;

(d) engaging said inner tubing string with said outer tubing string and placing an inner tubing bore of said inner tubing string in fluid communication with said subsurface formation through said communication passage; and (e) flowing well fluid from said subsurface formation through said communication passage and up through said inner tubing bore.

31. The method of claim 30, wherein:

in step (c) said inner tubing string includes an inner tubing closure valve on a lower end thereof which is maintained in a closed position during step (c); and step (d) includes engaging said inner tubing closure valve with said outer tubing string and moving said inner tubing closure valve to an open position and thereby placing said inner tubing bore in communication with said subsurface formation.

32. The method of claim 30, wherein:

in step (c) said inner tubing string includes a flow tester valve; and step (e) includes opening said flow tester valve to allow fluid to flow up through said inner tubing string.

33. The method of claim 32, further comprising:

repeatedly opening and closing said flow tester valve to perform multiple drawdown and buildup tests on said subsurface formation.

34. The method of claim 32, wherein:

in step (c) said tester valve is an annulus pressure responsive tester valve having a power port in fluid communication with a tubing annulus defined between said outer tubing string and said inner tubing string; and step (e) includes varying a fluid pressure in said tubing annulus to open said flow tester valve.

35. The method of claim 30, wherein:

in step (c) said inner tubing string includes an electronic gauge carrier; and said method further includes:

during step (e) measuring and recording a parameter of said well fluid.

36. The method of claim 30, wherein:

step (c) is performed after step (b).

37. The method of claim 30, wherein:

said inner tubing string is a coiled tubing string.

38. A system for testing a well, comprising:

an outer tubing string including:

a packer;

a communication passage communicating an interior of said outer tubing string with an exterior of said outer tubing string below said packer; and means for setting said packer in said well; and an inner tubing string received in said outer tubing string with a tubing annulus defined between said inner tubing string and said outer tubing string, said inner tubing string having a lower end engaged with said outer tubing string so that an inner tubing bore of said inner tubing string is communicated with said communication passage, said inner tubing string including an annulus pressure responsive tester valve having a power port communicated with said tubing annulus.

39. The system of claim 38, wherein:

said packer is a compression set packer.

40. The system of claim 38, wherein said inner tubing string further comprises an electronic gauge carrier.

41. The system of claim 38, wherein said inner tubing string further comprises a circulating valve.

42. The system of claim 38, wherein said inner tubing string is a coiled tubing string.

43. A method of treating a well having an uncased borehole intersecting a subsurface formation, comprising:

(a) running an outer tubing string into said well, said outer tubing string including a packer and including a communication passage communicating an interior of said outer tubing string with said borehole below said packer;

(b) setting said packer in said uncased borehole above said subsurface formation;

(c) running a fluid injection tool down into said outer tubing string;

(d) engaging said fluid injection tool with said outer tubing string and placing said fluid injection tool in fluid communication with said subsurface formation through said communication passage; and (e) injecting a treatment fluid from said fluid injection tool through said communication passage into said subsurface formation.

44. The method of claim 43, wherein said fluid injection tool includes a pressurized canister which is run into said well in step (c) on a wireline.

45. The method of claim 44, wherein:

in step (a), said outer tubing string includes a communication valve closing said communication passage;

in step (c), said fluid injection tool includes an injection valve; and step (d) includes engaging said communication valve with said injection valve and opening both said communication valve and said injection valve.

46. The method of claim 43, further comprising: providing a time delay between steps (d) and (e).

47. A method of testing a well having an uncased borehole intersecting a subsurface formation, comprising:

(a) running an outer tubing string into said well, said outer tubing string including an inflatable straddle packer and a downhole rotationally operated inflation pump and including a communication passage communicating an interior of said outer tubing string with said borehole below said packer;

(b) setting said packer in said uncased borehole above said subsurface formation including rotating said outer tubing string from a surface location to operate said inflation pump and inflate said straddle packer;

(c) running an inner tubing string into said outer tubing string;

(d) engaging said inner tubing string with said outer tubing string and placing an inner tubing bore of said inner tubing string in fluid communication with said subsurface formation through said communication passage; and (e) flowing well fluid from said subsurface formation through said communication passage and up through said inner tubing bore.

48. A method of testing a well having an uncased borehole intersecting a subsurface formation, comprising:

(a) running an outer tubing string into said well, said outer tubing string including a packer including a communication passage communicating an interior of said outer tubing string with said borehole below said packer;

(b) setting said packer in said cased borehole above said subsurface formation;

(c) running an inner tubing string into said outer tubing string, said inner tubing string including a sampler;

(d) engaging said inner tubing string with said outer tubing string and placing an inner tubing bore of said inner tubing string in fluid communication with said subsurface formation through said communication passage; and (e) flowing well fluid from said subsurface formation through said communication passage and up through said inner tubing bore and trapping a sample of said well fluid in said sampler.

49. A system for testing a well, comprising:

an outer tubing string including:

an inflatable straddle packer;

a communication passage communicating an interior of said outer tubing string with an exterior of said outer tubing string below said packer; and means for setting said packer in said well, said means for setting including a downhole pump operated by rotation of said outer tubing string; and an inner tubing string received in said outer tubing string with a tubing annulus defined between said inner tubing string and said outer tubing string, said inner tubing string having a lower end engaged with said outer tubing string so that an inner tubing bore of said inner tubing string is communicated with said communication passage, said inner tubing string including an annulus pressure responsive tester valve having a power port communicated with said tubing annulus.

50. A system for testing a well, comprising:

an outer tubing string including:

a packer;

a communication passage communicating an interior of said outer tubing string with an exterior of said outer tubing string below said packer; and means for setting said packer in said well; and an inner tubing string received in said outer tubing string with a tubing annulus defined between said inner tubing string and said outer tubing string, said inner tubing string having a lower end engaged with said outer tubing string so that an inner tubing bore of said inner tubing string is communicated with said communication passage, said inner tubing string including:

an annulus pressure responsive tester valve having a power port communicated with said tubing annulus; and a sampler.

* * * * *